US011717079B2

(12) United States Patent
Fehr et al.

(10) Patent No.: US 11,717,079 B2
(45) Date of Patent: Aug. 8, 2023

(54) METHODS AND APPARATUS TO SECURE A KEYBOARD WITH A MULTI-AXIS POSITIONABLE TRAY

(71) Applicant: CKnapp Sales, Inc., Goodfield, IL (US)

(72) Inventors: Micah Fehr, Danvers, IL (US); Nicholas Welander, East Peoria, IL (US); Brandon Meyer, Normal, IL (US); Chance Knapp, Goodfield, IL (US)

(73) Assignee: CKnapp Sales, Inc., Goodfield, IL (US)

( * ) Notice: Subject to any disclaimer, the term of this patent is extended or adjusted under 35 U.S.C. 154(b) by 0 days.

(21) Appl. No.: 17/231,694

(22) Filed: Apr. 15, 2021

(65) Prior Publication Data

US 2022/0151375 A1 May 19, 2022

Related U.S. Application Data

(63) Continuation-in-part of application No. 29/758,465, filed on Nov. 16, 2020.

(51) Int. Cl.
*A47B 21/00* (2006.01)
*A47B 21/03* (2006.01)

(52) U.S. Cl.
CPC .. *A47B 21/0314* (2013.01); *A47B 2021/0335* (2013.01)

(58) Field of Classification Search
CPC ..... A47B 21/0314; A47B 2021/0335; A47B 2021/0321; A47B 2200/0091; A47B 2200/0092; F16M 12/022; F16B 2/065
(Continued)

(56) References Cited

U.S. PATENT DOCUMENTS 3,865,336 A 2/1975 Robertson
D318,390 S 7/1991 Murray
(Continued)

FOREIGN PATENT DOCUMENTS

CA 2671910 * 12/2008
CN 208172737 U † 11/2018
(Continued)

OTHER PUBLICATIONS

Stand up Desk Store Compact Clamp-On Retractable Adjustable Height Under Desk Keyboard Tray, (Large, 33" Wide), retrieved from https://www.amazon.com/Stand-Up-Desk-Store-Retractable/dp/B0773TDLHG/ref=zg_bs_490623011_5?_encoding=UTF8&psc=1&refRID=FDRAVGN74P93R9AEY0PN on May 17, 2021, 1 page.
(Continued)

*Primary Examiner* — Janet M Wilkens
(74) *Attorney, Agent, or Firm* — Hanley, Flight & Zimmerman, LLC

(57) ABSTRACT

Methods, apparatus, systems and articles of manufacture are disclosed to secure a keyboard, the methods, apparatus, systems and articles of manufacture including a multi-axis positionable tray apparatus for securing a keyboard, the multi-axis positionable tray apparatus comprising: a tray portion, wherein the tray portion is configured to move along at least a first axis and a second axis, a first positioner to provide positional adjustment along the first axis, wherein the first positioner removably attaches the multi-axis positionable tray apparatus with respect to a mounting surface, and a second positioner to provide positional adjustment along the second axis, wherein the second positioner allows the multi-axis positionable tray to move towards a user.

20 Claims, 19 Drawing Sheets

(58) Field of Classification Search
USPC ..... 108/101, 3, 93, 97, 129, 50.01, 50.02, 108/143, 98; 248/229.25, 298.1, 346.03, 248/118.1, 276.1, 918, 231.71, 178.1; 312/208.1, 223.3; 400/715
See application file for complete search history.

(56) References Cited

U.S. PATENT DOCUMENTS

| | | | | |
|---|---|---|---|---|
| 5,211,367 | A * | 5/1993 | Musculus | F16M 11/24 248/575 |
| D337,907 | S | 8/1993 | Page | |
| D364,290 | S | 11/1995 | Watts | |
| 5,661,605 | A * | 8/1997 | Conway | A47B 21/0314 400/682 |
| 5,720,230 | A | 2/1998 | Mansfield | |
| 5,771,814 | A | 6/1998 | Clausen | |
| 5,836,562 | A * | 11/1998 | Danzyger | A47B 21/0314 248/231.71 |
| 5,961,231 | A * | 10/1999 | Ambrose | A47B 21/0371 400/715 |
| 6,079,676 | A * | 6/2000 | Hackett | A47B 21/0314 248/118.1 |
| 6,116,557 | A * | 9/2000 | Choy | A47B 21/0314 108/93 |
| 6,273,382 | B1 * | 8/2001 | Pemberton | A47B 21/0314 248/118.1 |
| 6,419,197 | B2 * | 7/2002 | Kochanski | A47B 21/0314 108/97 |
| 6,454,369 | B1 * | 9/2002 | Cooper | A47B 21/0314 312/334.44 |
| 6,874,736 | B1 * | 4/2005 | Jones | A47B 21/0371 248/118 |
| 7,516,923 | B2 * | 4/2009 | Rossini | A47B 21/0314 248/118 |
| 8,061,668 | B1 * | 11/2011 | Cvek | A47B 21/0371 248/118 |
| 8,740,166 | B2 * | 6/2014 | Hamilton | A47B 21/0314 108/93 |
| D840,182 | S | 2/2019 | Warden et al. | |
| D861,403 | S | 10/2019 | Hurford | |
| D916,517 | S | 4/2021 | Lozada | |
| D928,795 | S | 8/2021 | Zhang | |
| 2005/0285004 | A1 * | 12/2005 | Elgie | A47B 21/0314 248/346.01 |
| 2007/0001077 | A1 * | 1/2007 | Kirchhoff | A47B 21/0314 108/138 |
| 2017/0295924 | A1 * | 10/2017 | Getz | A47B 97/00 |
| 2020/0107634 | A1 | 4/2020 | Hendrix et al. | |
| 2020/0187638 | A1 * | 6/2020 | Ho | A47B 88/48 |
| 2022/0151375 | A1 | 5/2022 | Fehr et al. | |

FOREIGN PATENT DOCUMENTS

| | | | |
|---|---|---|---|
| CN | 208689549 U | † | 4/2019 |
| CN | 209587504 U | † | 11/2019 |
| JP | 3220592 | * | 3/2019 |
| WO | 0102938 | * | 1/2001 |
| WO | 2016040739 | * | 3/2016 |

OTHER PUBLICATIONS

VIVO "VIVO Large Keyboard Tray Under Desk Pull out with Extra Sturdy C Clamp Mount System, Black 27×11 inch Slide-Out Platform Computer Drawer for Typing and Mouse Work (Mount-KB05E)," retrieved from https://www.amazon.com/dp/B07HFDJCSL on Nov. 16, 2020, 1 page.

United States Patent and Trademark Office, "Non-Final Office Action," issued in connection with U.S. Appl. No. 29/758,465, dated Jul. 22, 2022, 8 pages.

United States Patent and Trademark Office, "Advisory Action," issued in connection with U.S. Appl. No. 29/798,556, dated Mar. 6, 2023, 3 pages.

United States Patent and Trademark Office, "Final Office Action," issued in connection with U.S. Appl. No. 29/798,556, dated Nov. 25, 2022, 5 pages.

United States Patent and Trademark Office, "Non-Final Office Action," issued in connection with U.S. Appl. No. 29/798,556, dated Jul. 28, 2022, 7 pages.

Clamp Keyboard Tray. Mount-It! (online), available Nov. 21, 2018, retrieved Jul. 15, 2022. 12 pages. <https://www.amazon.com/dp/B07HFDJCSL>.

Large Keyboard Tray Under Desk Pull out. Vivo, (online, available Sep. 17, 2018, retrieved Jul. 15, 2022, 12 pages. <https://www.amazon.com/Mount-Clamp-Keyboard-Tray-Installation/dp/B07GQT1XVD>.

* cited by examiner
† cited by third party

METHODS AND APPARATUS TO SECURE A KEYBOARD WITH A MULTI-AXIS POSITIONABLE TRAY

RELATED APPLICATION

This patent arises from a continuation-in-part of U.S. Design Patent Application Serial No. 29/758,465 which was filed on Nov. 16, 2020. U.S. Design Patent Application Serial No. 29/758,465 is hereby incorporated herein by reference in its entirety. Priority to U.S. Design Patent Application Serial No. 29/758,465 is hereby claimed.

DISCLOSURE

This disclosure relates generally to keyboard trays, and, more particularly, to methods and apparatus to secure a keyboard with a multi-axis positionable tray.

BACKGROUND

In recent years, keyboards have been used as input devices for computers. Keyboards have been connected through the use of wires (e.g., cables), wirelessly (e.g., through Bluetooth™) and some keyboards are integrated into the computer such as with a laptop. To be useful, a keyboard must be positioned with respect to a computing device with which the keyboard is to be used. There is a need for improved positioning apparatus to accommodate a variety of environments in which the computing device may be used.

Figure 1:
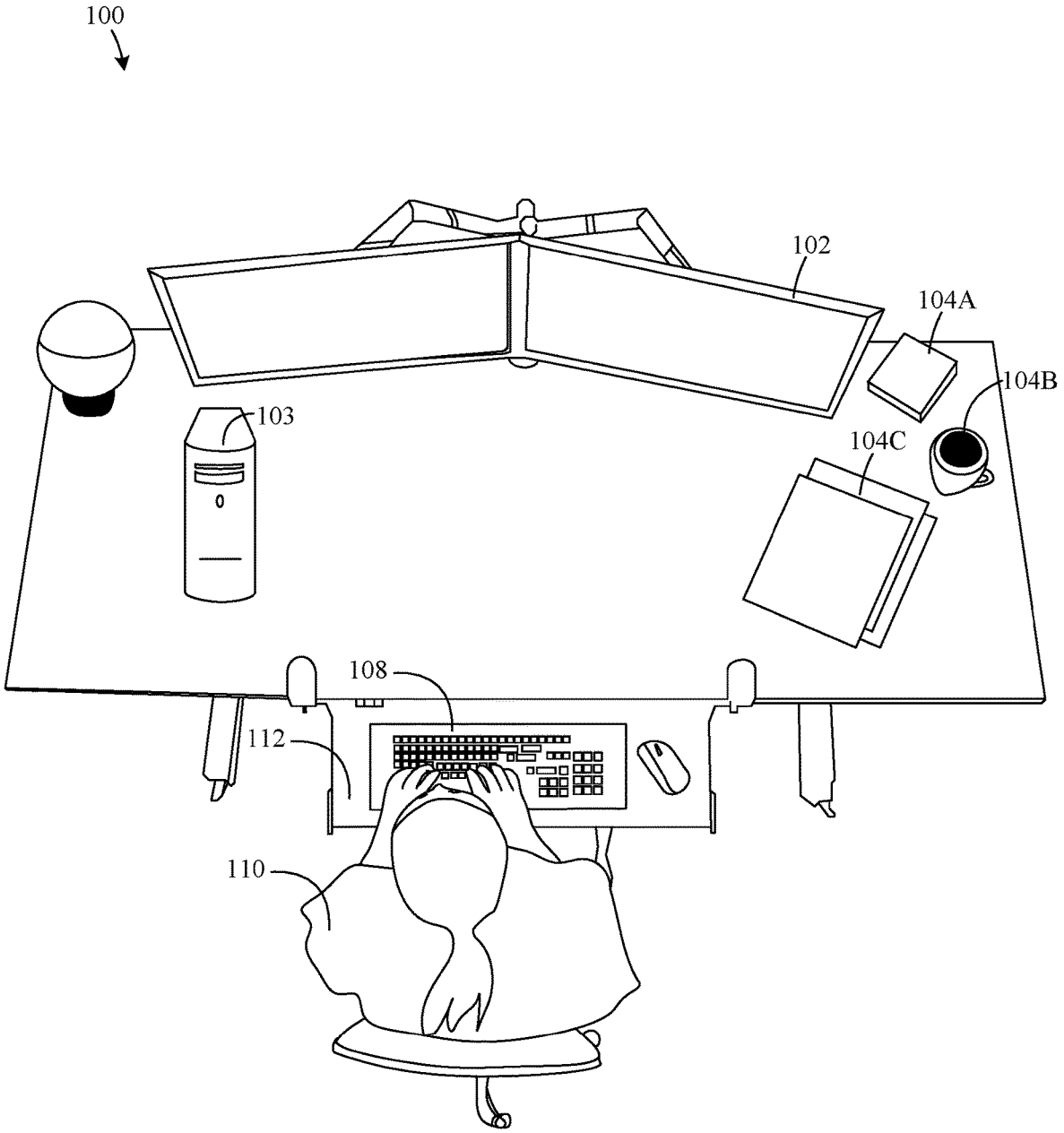
FIG. 1 is an example environment top-view illustrating a keyboard, desktop monitor, desktop computing device, desk items, a desk, and a multi-axis positionable tray, the multi-axis positionable tray capable of vertical adjustment, horizontal adjustment and lateral adjustment.

The figures are not to scale. Instead, the thickness of the layers or regions may be enlarged in the drawings. Although the figures show layers and regions with clean lines and boundaries, some or all of these lines and/or boundaries may be idealized. In reality, the boundaries and/or lines may be unobservable, blended, and/or irregular. In general, the same reference numbers will be used throughout the drawing(s) and accompanying written description to refer to the same or like parts. As used herein, unless otherwise stated, the term "above" describes the relationship of two parts relative to Earth. A first part is above a second part, if the second part has at least one part between Earth and the first part. Likewise, as used herein, a first part is "below" a second part when the first part is closer to the Earth than the second part. As noted above, a first part can be above or below a second part with one or more of: other parts therebetween, without other parts therebetween, with the first and second parts touching, or without the first and second parts being in direct contact with one another. As used in this patent, stating that any part (e.g., a layer, film, area, region, or plate) is in any way on (e.g., positioned on, located on, disposed on, or formed on, etc.) another part, indicates that the referenced part is either in contact with the other part, or that the referenced part is above the other part with one or more intermediate part(s) located therebetween. As used herein, connection references (e.g., attached, coupled, connected, and joined) may include intermediate members between the elements referenced by the connection reference and/or relative movement between those elements unless otherwise indicated. As such, connection references do not necessarily infer that two elements are directly connected and/or in fixed relation to each other. As used herein, stating that any part is in "contact" with another part is defined to mean that there is no intermediate part between the two parts.

Unless specifically stated otherwise, descriptors such as "first," "second," "third," etc. are used herein without imputing or otherwise indicating any meaning of priority, physical order, arrangement in a list, and/or ordering in any way, but are merely used as labels and/or arbitrary names to distinguish elements for ease of understanding the disclosed examples. In some examples, the descriptor "first" may be used to refer to an element in the detailed description, while the same element may be referred to in a claim with a different descriptor such as "second" or "third." In such instances, it should be understood that such descriptors are used merely for identifying those elements distinctly that might, for example, otherwise share a same name. As used herein, "approximately" and "about" refer to dimensions that may not be exact due to manufacturing tolerances and/or other real world imperfections.

DETAILED DESCRIPTION

The increase of desktop computers and other computing devices in recent years has led to an increase in corresponding keyboards. Some computing devices are laptops including a keyboard integrated into the computing device. In other examples, the keyboard is connected to a desktop computer and/or an associated display device (e.g., monitor, screen, etc.). In some examples, the keyboard is wirelessly connected to a computing device, such as a desktop computer, a laptop computer, a tablet computer, a smart phone, etc. These keyboards are structured to input information (characters, letters, numbers) to the computing device. In some examples, moving the wireless keyboard to a keyboard tray from a desk frees space for other items on the desk. Additionally, a tray that can attach and position a keyboard with respect to a desk, a table, a counter, and/or other surface provides flexibility to facilitate interaction with a computing device in a variety of environments.

FIG. 1 is a top view of an example environment 100 in which a computing device is used. The example environment 100 of FIG. 1 includes an example desktop monitor 102, a desktop computing device 103, desk items 104A, 104B, 104C, a desk 106, a keyboard 108, a user 110 and a multi-axis positionable tray apparatus 112. In the example of FIG. 1, the example multi-axis positionable tray apparatus 112 is structured with multi-axis positionability including a vertical adjustment, a horizontal adjustment and a lateral adjustment. The example desktop monitor (e.g., screen, display, output device, etc.) 102 is able to display the characters entered by the example keyboard 108. The example desktop computing device 103 is able to transfer the keyboard strokes to the example desktop monitor 102, and, in some examples, the desktop computing device 103 is large and utilizes desk space. In the example of FIG. 1, the desk items 104 are placed on the example desk 106. In the example of FIG. 1, desk item 104A is a book, desk item 104B is a coffee cup, and desk item 104C is a stack of papers. In other examples, desk space is at a premium as there may be other desk items 104 utilizing space on the example desk 106. In the example of FIG. 1, the example keyboard 108 is wirelessly connected to the example desktop computing device 103, which is also occupying space on the example desk 106. In the example of FIG. 1, the example keyboard 108 is not located on the example desk 106, such that there is an increase in available (e.g., free) space in the area of the example desk 106. The example keyboard 108 is positioned off of the example desk 106 (e.g., under the example desk 106, etc.) using the example multi-axis positionable tray apparatus 112. In some examples, the multi-axis positionable tray apparatus 112 is located underneath the example desk 106.

Figure 2:
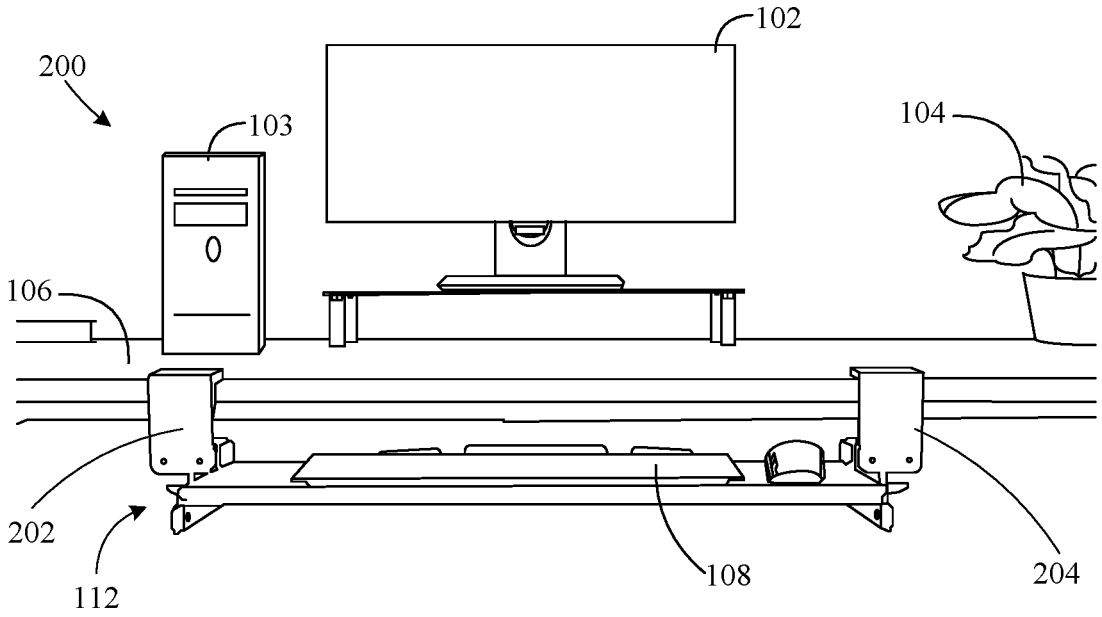
FIG. 2 is an example environment side-view illustrating a computer mouse, the desktop monitor, the desktop computing device, the example keyboard, the example desk, and the example multi-axis positionable tray.

FIG. 2 illustrates a side view of the example multi-axis positionable tray apparatus 112 (e.g., sliding tray, multi-axis positionable and adjustable tray apparatus, adjustable tray, multi-dimensional tray, hanging tray, movable tray, under-desk sliding tray, pull-out tray, adjustable input device support, etc.) of FIG. 1 in another example environment 200. In the example of FIG. 2, the example desktop monitor 102 is placed next to the example desktop computing device 103 and the example desk item 104 on the example desk 106. The example keyboard 108 is placed on the example multi-axis positionable tray apparatus 112. The example multi-axis positionable tray apparatus 112 is fastened (e.g., connected, attached, affixed) to the example desk 106 by an example first clamp 202 and an example second clamp 204. The example first clamp 202 and the example second clamp 204 are able to fasten the example multi-axis positionable tray apparatus 112 to the example desk 106. The example first clamp 202 and the example second clamp 204 act as a first positioner to suspend (e.g., hang) the multi-axis positionable tray apparatus 112 above the floor (e.g., the ground). The example first clamp 202 and the example second clamp 204 act as a first positioner to suspend (e.g., hang) the multi-axis positionable tray apparatus 112 from a first mounting surface (e.g., the desk 106, a table, a counter, etc.). The example first clamp 202 and the example second clamp 204 act as a first positioner to removably attach (e.g., clamp, hang, secure, etc.) the multi-axis positionable tray apparatus 112 with respect to a mounting surface (e.g., the desk 106, a table, a counter, etc.). In the example of FIG. 2, the example first clamp 202 and the corresponding example second clamp 204 each have a first edge to attach to the example desk 106 and a screw that is used to tighten the example first clamp 202 and the example second clamp 204 to the example desk 106. Further details are described in conjunction with FIGS. 4A-B.

Figure 3:
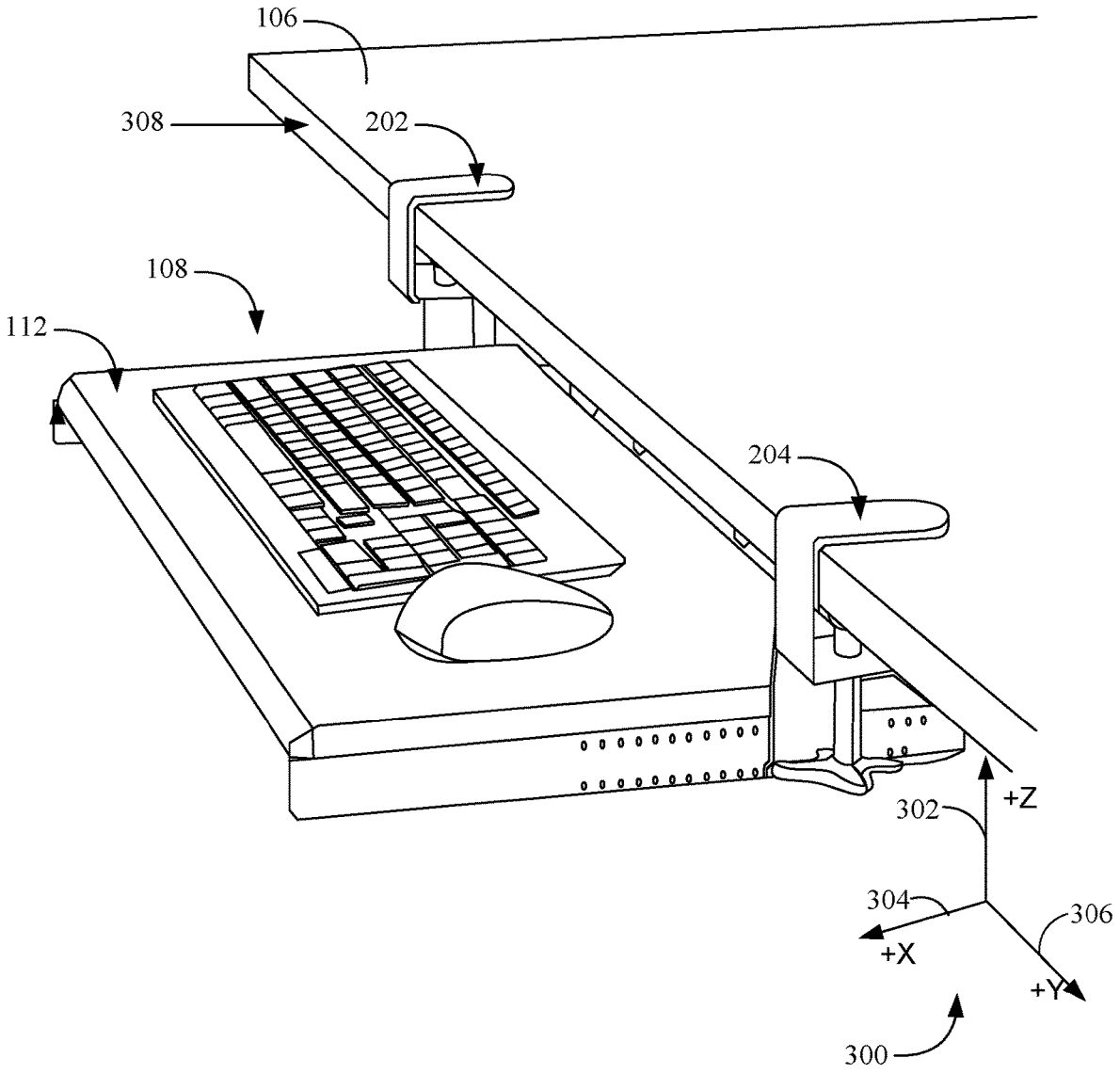
FIG. 3 is an illustration of the different axes the example multi-axis positionable tray is constrained to move.

FIG. 3 illustrates an example coordinate system 300 defined to show different directions in which the example multi-axis positionable tray apparatus 112 is constrained to move. For example, the user of the keyboard 108 may have hands that reach to a natural, ergonomic typing position. The multi-axis positionable tray apparatus 112 can be positioned (e.g., arranged, movably secured, suspended etc.) above the ground (e.g., floor) such that hands of the user are able to rest on the keyboard 108. The example first clamp 202 and the example second clamp 204 suspend (e.g., hang, movably secure, arrange) the multi-axis positionable tray apparatus 112 above the ground (e.g., floor) such that the legs of the user are not constricted by the placement (e.g., position) of the example keyboard 108. The example first clamp 202 and the example second clamp 204 act as a first positioner to removably attach (e.g., clamp, hang, secure, etc.) the multi-axis positionable tray apparatus 112 with respect to a mounting surface (e.g., the desk 106, a table, a counter, etc.) such that the legs of the user are not constricted by the placement (e.g., position) of the example keyboard 108. The example multi-axis positionable tray apparatus 112 is movable along the horizontal axis X 304 to position the multi-axis positionable tray apparatus 112 and the example keyboard 108 with respect to the user and the desk, table, counter, and/or other surface to allow user interaction. As the multi-axis positionable tray apparatus 112 slides along the horizontal axis X 304, the multi-axis positionable tray apparatus 112 travels underneath the example desk 106, while the example first clamp 202 and example second clamp 204 stay firmly affixed to the example desk 106. The example first clamp 202 and the example second clamp 204 act together to constrain the vertical position (e.g., height) of the example multi-axis positionable tray apparatus 112 with respect to the example desk 106 and/or other surface to which the example multi-axis positionable tray apparatus 112 is mounted.

As shown in FIG. 3, the multi-axis positionable tray apparatus 112 defines a set of axes 302-306 in rectilinear coordinates: a vertical axis Z 302, a horizontal axis X 304, and a lateral axis Y 306. The lateral axis Y 306 extends across the multi-axis positionable tray apparatus 112 as shown by the reference arrow. The vertical axis Z 302 extends through the multi-axis positionable tray apparatus 112 as shown by the reference arrow such that the height of the multi-axis positionable tray apparatus 112 can be lowered or raised depending on user ergonomic preferences. The horizontal axis X 304 extends towards the user (not shown in this view) and away from the monitor (not shown in this view) as described by the reference arrow. In some examples, the multi-axis positionable tray apparatus 112 is movable (e.g., to slide, extend, travel) such as a distance of 0 to 9 inches (e.g., 1 inch, 2 inches, 3 inches, 4 inches, 4.5 inches, 5 inches, 6 inches, 7 inches, 8 inches, 8.5 inches, 9 inches, etc.) from the example desk edge 308 along the X axis 304. As such, the horizontal adjustment, as explained by example multi-axis positionable tray apparatus 112 provides multi-axis adjustability with respect to a surface (e.g., desk, table, counter, etc.) to which the example multi-axis positionable tray apparatus 112 is attached.

The example multi-axis positionable tray apparatus 112 includes a first positioner to adjust the position along a first axis (e.g., the vertical axis Z 302), a second positioner to adjust the position along a second axis (e.g., the horizontal axis X 304), and a third positioner to adjust the position along a third axis (e.g., lateral axis Y 306). The example first positioner is explained in conjunction with the example first clamp 202 in FIG. 4A. The example second positioner is further explained in conjunction with the example rail system 414 in FIGS. 4A-B. The example third positioner is further explained in conjunction with first bracket 710 and the second bracket 712 in FIGS. 7A-B.

Figure 4A:
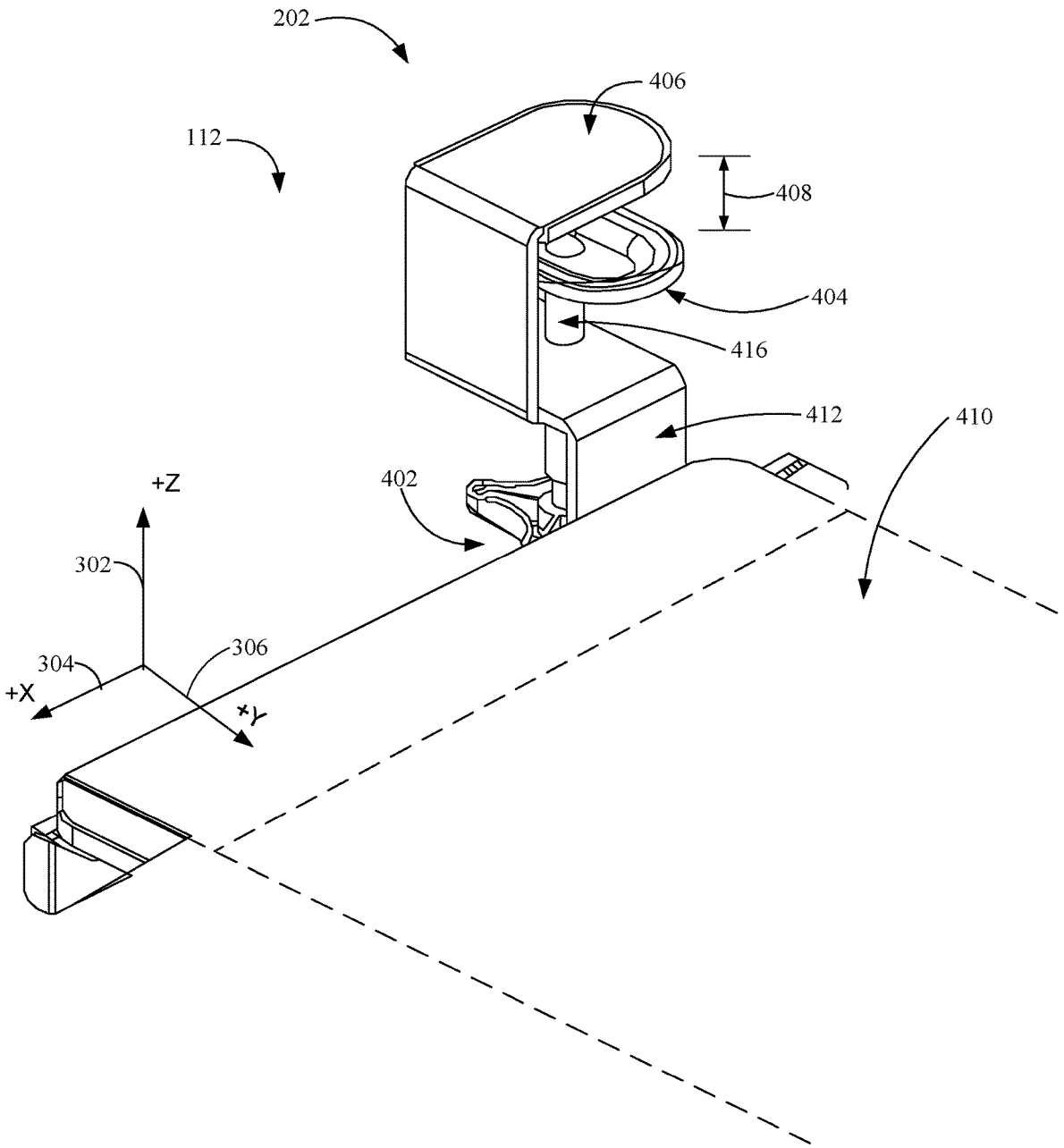
FIG. 4A is a top perspective view of a clamp of the multi-axis positionable tray.

FIG. 4A illustrates a top perspective view of the first clamp 202. However, the example second clamp 204 (not shown in this view) is identical to the example first clamp 202. The coordinate system 300 described in FIG. 3 is included in FIG. 4A for reference. In the example of FIG. 4A, a tray portion 410 of the multi-axis positionable tray apparatus 112 is fully extended from the example desk (not shown in this view). In some examples, the tray portion 410 is referred to as an input device support such that the keyboard and mouse are input devices, which are resting on the tray portion 410. In the example of FIG. 4A, the position of the example multi-axis positionable tray apparatus 112 is such that the example multi-axis positionable tray apparatus 112 can no longer move (e.g., slide, travel along the rails, etc.) in the +X direction, but is able to move (e.g., slide, travel along the rails, etc.) underneath the desk (not shown in this view) in the direction opposite the +X of the horizontal axis X 304. In the example of FIG. 4A, the tray portion 410 of the multi-axis positionable tray apparatus 112 is extended 8.5 inches from the desk edge.

The example first clamp 202 (e.g., clamp, pad and screw, first vertical positioner, etc.) includes an adjustment knob 402 (e.g., handle), a first (e.g., bottom or supporting) jaw or a first clamping member 404, and a second (e.g., top or hanging) jaw or a second clamping member 406, and a screw 416. The example clamp 202 also includes an example first adjustment plate 412 which interacts with an example second adjustment plate 413 (shown in FIG. 4B), and an example rail system 414 (e.g., sliding bracket, sliding rail, etc.), where the second adjustment plate 413 and the example rail system 414 are not shown in the view of FIG. 4A. The example adjustment knob 402 is configured to twist clockwise or counter-clockwise to tighten the first jaw or the first clamping member 404 into the second jaw or the second clamping member 406. In the example of FIG. 4A, the example desk 106 is not shown in this view, but the width (e.g., thickness) of the example desk 106 is illustrated by an example distance 408. Depending on the width of the example desk (not shown in this view), the example adjustment knob 402 is configured to secure the first jaw or the first clamping member 404 to the bottom edge of the desk, while the second jaw or the second clamping member 406 is configured to secure the top edge of the desk.

Figure 4B:
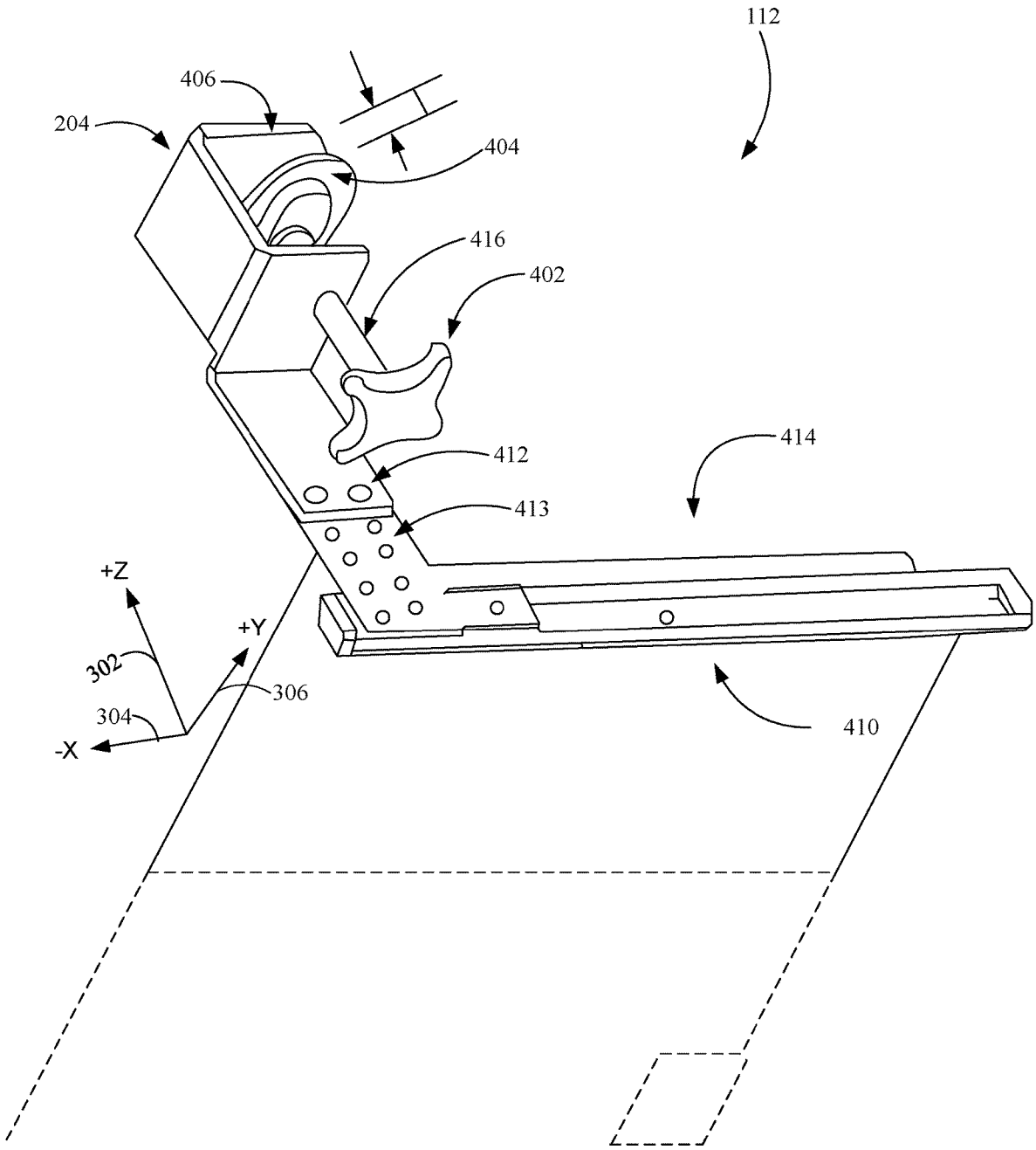
FIG. 4B is a bottom perspective view of one of the example clamps of the multi-axis positionable tray.

FIG. 4B illustrates a bottom perspective view of the example second clamp 204. However, the example first clamp 202 (not shown in this view) is identical to the example second clamp 204. The coordinate system described in FIG. 3 is included in FIG. 4 for reference, wherein −X illustrates the different orientation. In the example of FIG. 4, the tray portion 410 of the multi-axis positionable tray apparatus 112 is fully underneath (e.g., tucked away) the example desk (not shown in this view). In the example of FIG. 4B, the tray portion is 0 inches from the desk edge, but in other examples the position of the tray portion 410 may be 4.24 inches from the desk edge, and in the example of FIG. 4A, the position of the tray portion 410 is 8.5 inches from the desk edge. In certain examples, the tray portion 410 can be positioned at any point along the horizontal axis X 304 within the bounds of the example rail system 414 (e.g., second positioner, sliding rail, sliding bracket, etc.).

In FIG. 4B, the example first clamp 202 includes the example adjustment knob 402, the example first jaw or clamping member 404, the example second jaw or clamping member 406, the example first adjustment plate 412 (which interacts with the example second adjustment plate 413), and the example rail system 414. As shown in the example of FIG. 4B, the second adjustment plate 413 is attached to or integrated with the rail system 414, for example. The example adjustment knob 402, the first jaw or the first clamping member 404, and second jaw or the second clamping member 406 operate as in the example of FIG. 4A.

The example adjustment plates 412-413 interact to provide a vertical adjustment mechanism for the multi-axis positionable tray apparatus 112. As shown in the example of FIG. 4B, the example first adjustment plate 412 and the example second adjustment plate 413 each include a plurality of openings or holes, wherein the holes allow the tray portion 410 of the example multi-axis positionable tray apparatus 112 to be positioned on the vertical axis Z 302 at a height or distance selected from a plurality of heights/distances with respect to the desk, table, or other surface to which the multi-axis positionable tray apparatus 112 is mounted. In some examples, the adjustment plates 412-413 each include one or more pairs or sets of openings or holes, and a pair of pins, screws, posts, etc., can be used to removably connect the adjustment plates 412 and 413 to position the tray portion 410 of the example multi-axis positionable tray apparatus 112 at a discrete position corresponding to the alignment of holes in the adjustment plates 412 and 413. For example, a first alignment of the first adjustment plate 412 and the second adjustment plate 413 can position the tray portion 410 at a height or distance of 2 inches below the desk, table, counter, or other surface to which the example multi-axis positionable tray apparatus 112 is mounted, and a second alignment of the first adjustment plate 412 and the second adjustment plate 413 can position the tray portion 410 at a height of 4 inches below the desk, table, counter, or other surface to which the example multi-axis positionable tray apparatus 112 is mounted. In this example, the multi-axis positionable tray apparatus 112 can be positioned at either the first alignment or the second alignment depending on a desired distance between the tray portion 410 and the desk, table, counter, or other surface to which the example multi-axis positionable tray apparatus 112 is mounted. The example adjustment plates 412-413 enable the adjustment of the multi-axis positionable tray apparatus 112 along a first axis (e.g., the vertical axis Z 302). The example adjustment plates 412-413 are further described in connection with FIG. 9A and FIG. 9B.

The example rail system 414 allows the example tray portion 410 of the multi-axis positionable tray apparatus 112 to slide forward and/or backward along a second axis X 304. In some examples, the tray portion 410 of the multi-axis positionable tray apparatus 112 is able to slide a total of 8.5 inches from the edge of the desk (not shown in this view) towards the user along the second axis 304 (e.g., the horizontal axis, the axis X 304). The example rail system 414 acts as second positioner to allow the multi-axis positionable tray apparatus 112 to move toward and/or away from a user. The second positioner of the example rail system 414 enables the tray to be located at any point along a length of the example rail system 414 following the second axis.

Figure 5A:
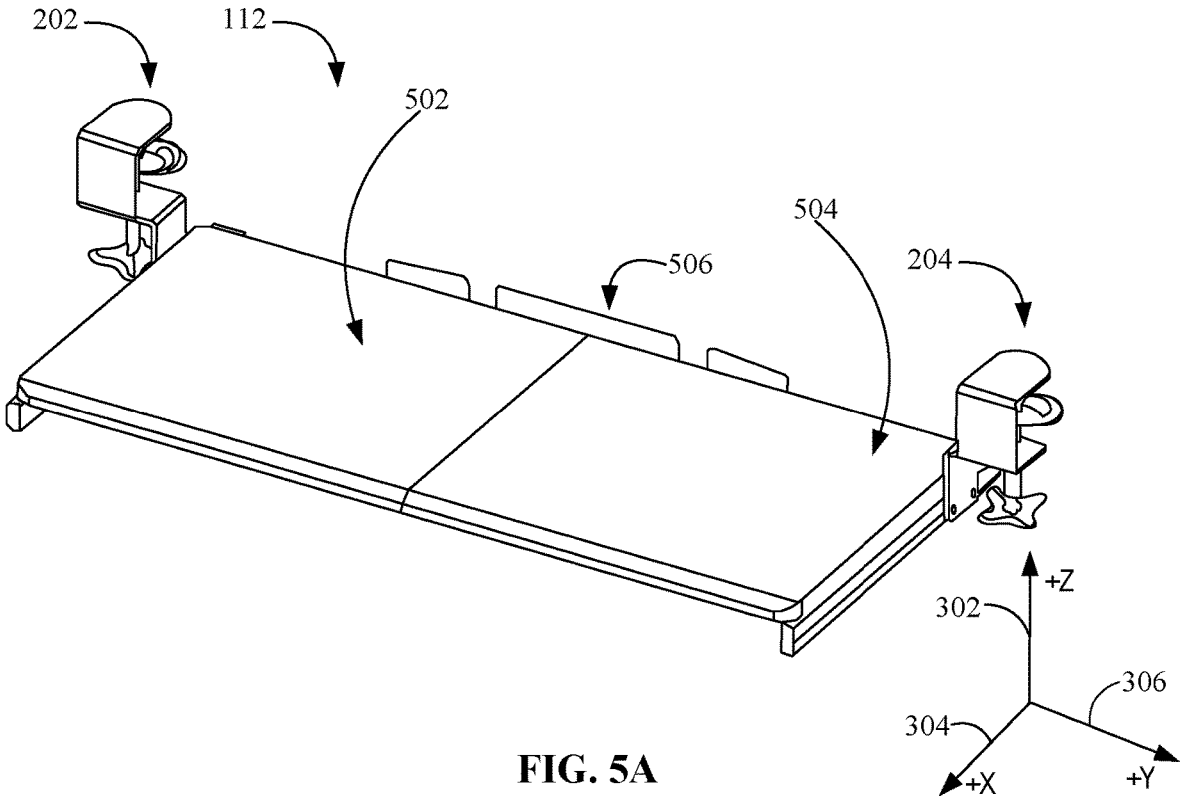
FIG. 5A is a top perspective view of an example variation of the multi-axis positionable tray wherein a first portion is detachable from a second portion.
Figure 6A:
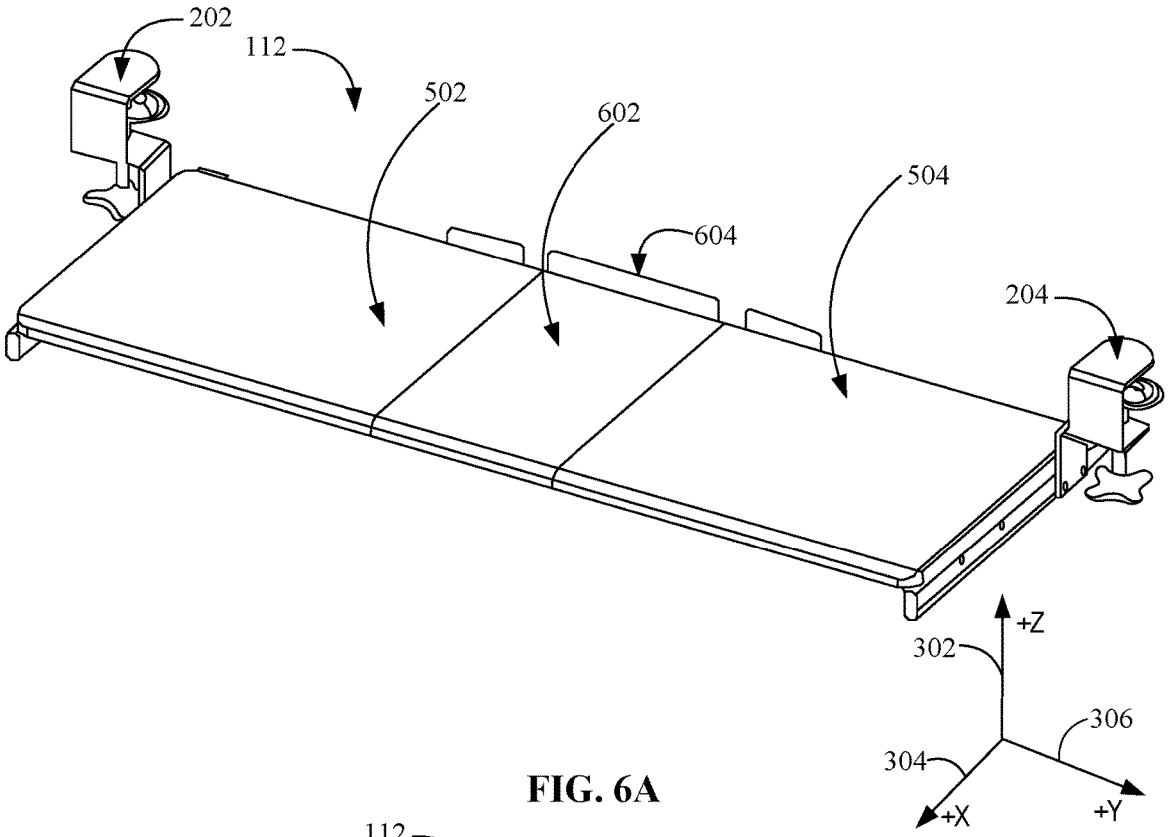
FIG. 6A is a top perspective view of an example variation of the multi-axis positionable tray wherein a first portion is detachable from a second portion further including a third portion.

FIG. 5A is an example perspective view of an example variation of the multi-axis positionable tray apparatus 112 wherein a first portion 502 is detachable from a second portion 504. In the example of FIG. 5A, the first clamp 202 is configured to secure (e.g., support) the first portion 502 of the example multi-axis positionable tray apparatus 112, such that the second clamp 204 is configured to secure (e.g., support) the second portion 504 of the example multi-axis positionable tray apparatus 112. The example of FIG. 5A also includes an example backstop 506 (e.g., backplate, guard rail, etc.). The example variation of the multi-axis positionable tray apparatus 112 is able to separate (e.g., detach) such that a third portion may be included in between the first portion 502 and the second portion 504 as shown in the example of FIG. 6A. In the example of FIG. 5A, the first portion 502 and the second portion 504 are roughly (e.g., substantially, approximately) the same dimensions. In some examples, the first portion is manufactured out of medium density fiberboard (MDF) material, wood, glass, particleboard, etc.

In some examples, the first portion 502 and the second portion 504 is manufactured in a factory, and then shipped to a customer (e.g., a retail store, direct address of customer, online retailer, etc.). In these examples, the first portion 502 and the second portion 504 are shipped together, such that the packaging dimensions (e.g., volume, length and width) are smaller, wherein the multi-axis positionable tray apparatus 112 may be shipped with a 35% reduction in shipping expenses.

Figure 5B:
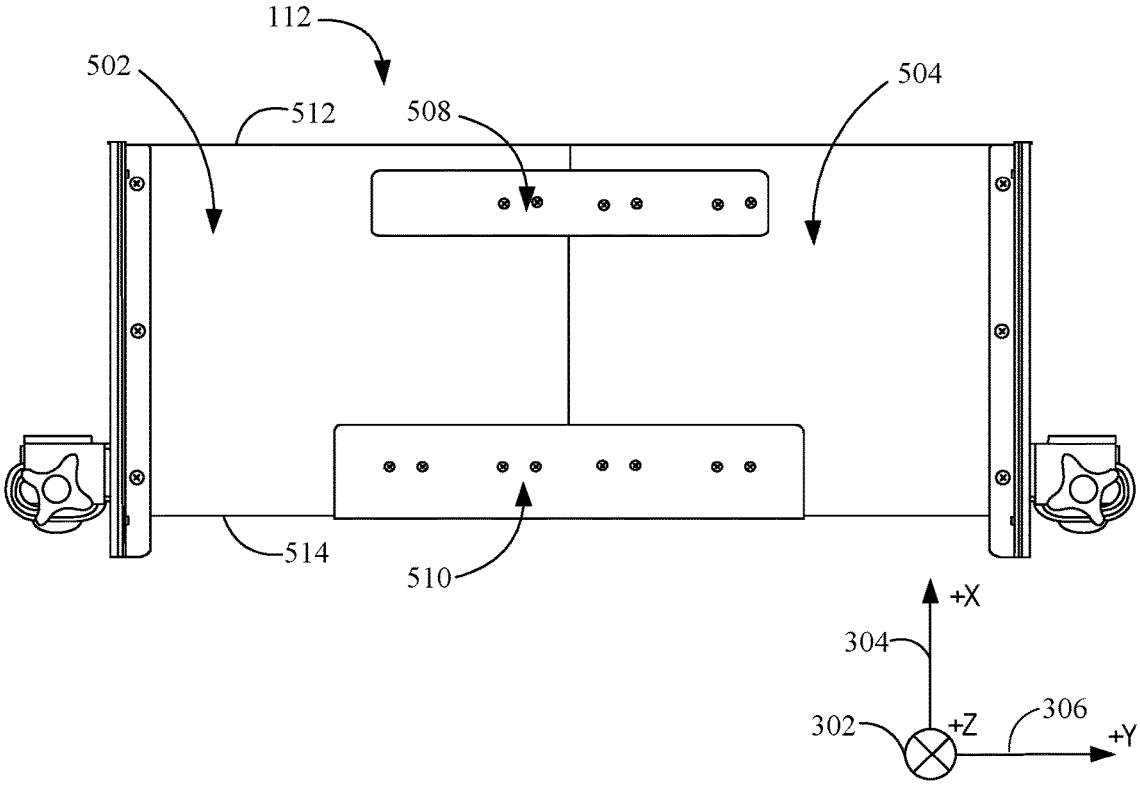
FIG. 5B is a bottom view of the example variation of the multi-axis positionable tray of FIG. 5A.

FIG. 5B is the bottom view of the example first portion 502 and the example second portion 504 of FIG. 5A. In the example of FIG. 5B, a first portion connector 508 (e.g., a front plate portion connector) and a second portion connector 510 is illustrated. In the example of FIG. 5B, the first portion connector 508 is configured to attach the first portion 502 of the multi-axis positionable tray apparatus 112 to the second portion 504 of the example multi-axis positionable tray apparatus 112 near a first edge of the example multi-axis positionable tray apparatus 112 (e.g., first edge 512). The example second portion connector 510 is configured to attach to the first portion 502 and the second portion 504 near a second edge (e.g., a second edge 514) of the example multi-axis positionable tray apparatus 112. As used, herein, "near" may refer to "close, proximate, located next to."

FIG. 6A is an example perspective view of an example variation of the multi-axis positionable tray apparatus 112 wherein a first portion 502 is detachable from a second portion 504 further including a third portion 602. The example variation of the multi-axis positionable tray apparatus 112 is configured such that the first portion 502, the second portion 504, and the third portion 602 are all able to be shipped from the manufacturer in a single package saving packaging costs. The addition of the example third portion 602 allows for a horizontal adjustment in the multi-axis positionable tray apparatus 112. The multi-axis positionable tray apparatus 112 can be adjusted along the vertical axis Z 302, along with adjusted along the horizontal axis X 304, and now with the addition of the third portion 602, can be adjusted along the lateral axis Y 306. The example backstop 604 of FIG. 6A, is configured to prevent an example keyboard from falling off the example tray portion 410 of the multi-axis positionable tray apparatus 112. In some examples, the third portion 602 is called a "standard leaf" and is approximately 6.75 inches length wise (along the lateral axis Y 306). The addition or removal of the third portion 602 allows a lateral adjustment such that the third portion 602 is a second positioner.

Figure 6B:
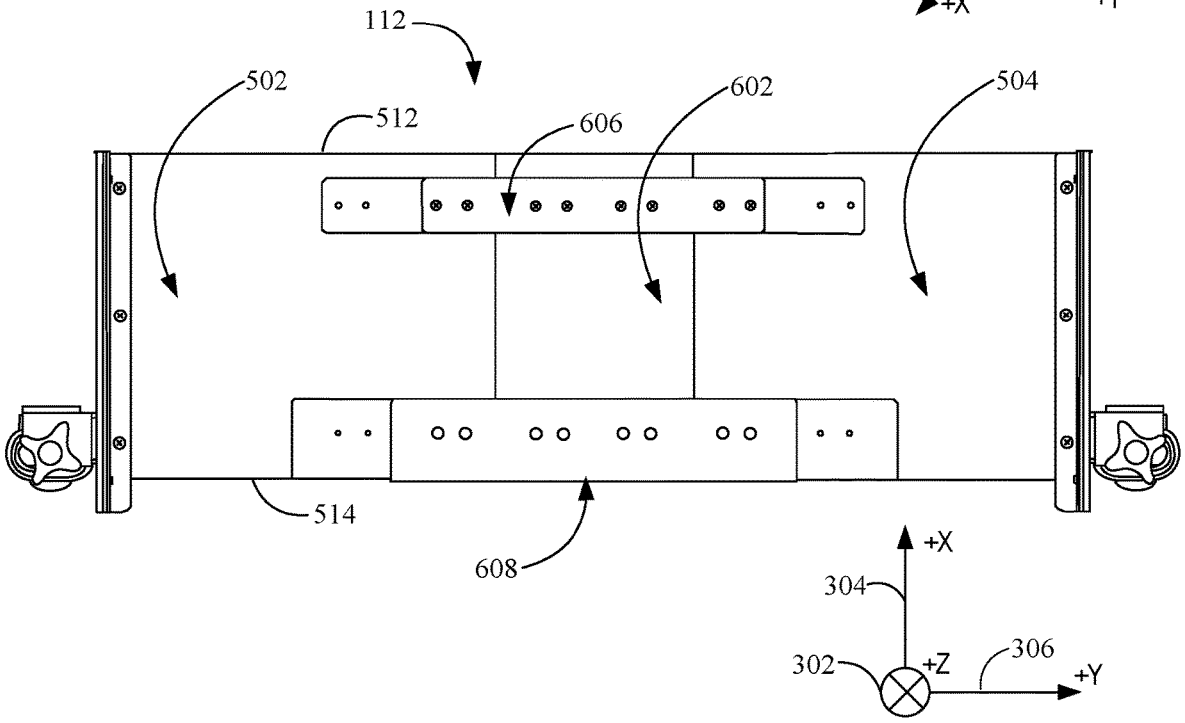
FIG. 6B is a bottom view of the example variation of the multi-axis positionable tray of FIG. 6A.

In the example of FIG. 6B, a bottom view of the three piece variant of FIG. 6A is shown. In the bottom view, the first portion connector 606 is configured to connect the first portion 502, the second portion 504 and the third portion 602 near the first edge 512. The example second portion connector 608 is configured to connect the first portion 502, the second portion 504, and the third portion 602 near the second edge 514. Due to the additional third portion 602, the first portion connector 606 and the second portion connector 608 are thicker (e.g., more durable) than the counterpart (e.g., corresponding, similar, etc.) first portion connector 508 of FIG. 5B and counterpart (e.g., corresponding, similar, etc.) portion connector 510 of FIG. 5B.

Figure 7A:
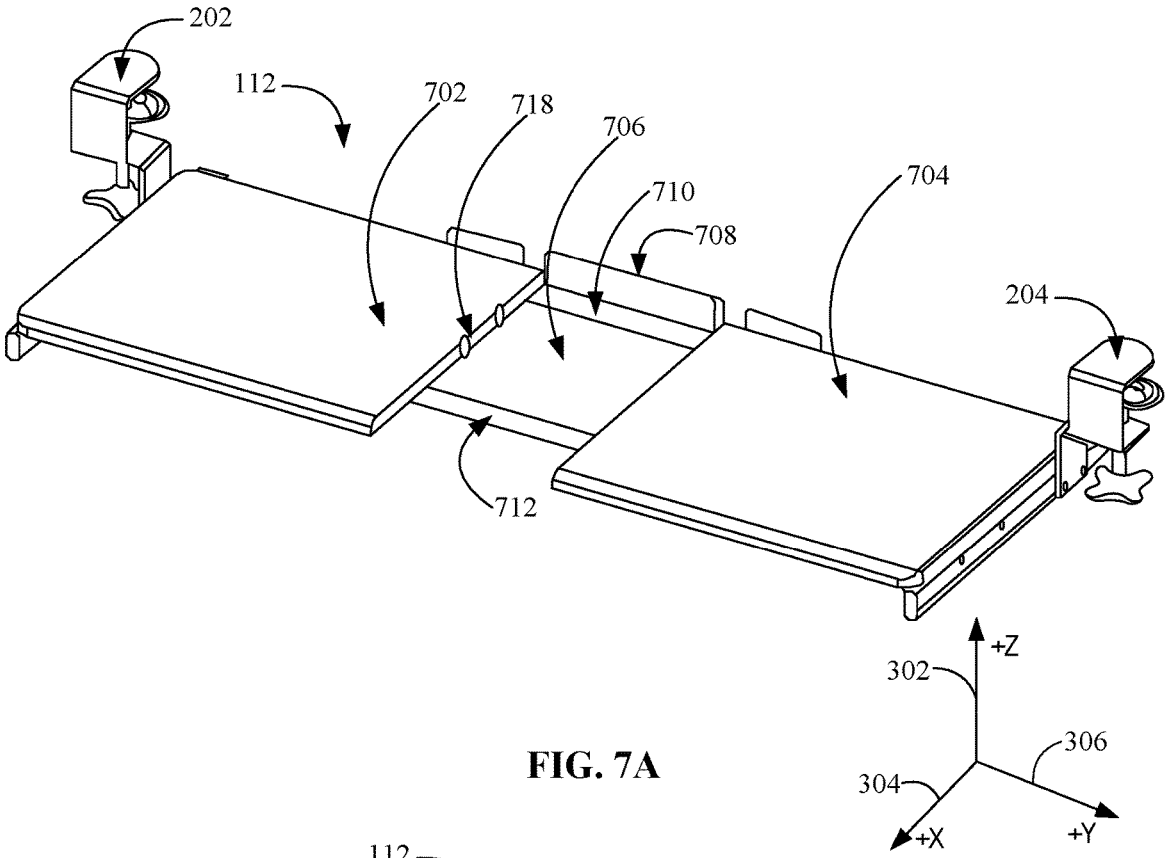
FIG. 7A is a top perspective view of an example variation of the multi-axis positionable tray wherein the multi-axis positionable tray is configured for split keyboards.

FIG. 7A illustrates an example variation, wherein the third portion 602 (e.g., middle leaf) of FIG. 6AB is removed. In some examples, the third portion 602 (e.g., middle leaf) is not included in the purchase of the multi-axis positionable tray apparatus 112. The example variation of the multi-axis positionable tray apparatus 112 of the example of FIG. 7A would be useful for keyboards that are split (such as the Kinesis Freestyle2 Keyboard for PC Kb800pb-US as illustrated in FIG. 7C and FIG. 7D), wherein the left hand side of the split keyboard may be located on the first portion 702, and the right hand side of the split keyboard may be located on the second portion 704. The example gap 706 (e.g., opening, space, absence of tray) allows the lateral (e.g., side to side) adjustment of the keyboard tray such that the positioning of the first portion 702 and the second portion 704 may be located at any point along the lateral axis Y 306. The example first portion 702 and the example second portion 704 are supported by the backstop 708, the first bracket 710 and the second bracket 712. In the example of FIG. 7A, the example first bracket 710 and the example second bracket 712 is the second positioner to allow for the lateral adjustment of the multi-axis positionable tray apparatus 112.

Figure 7B:
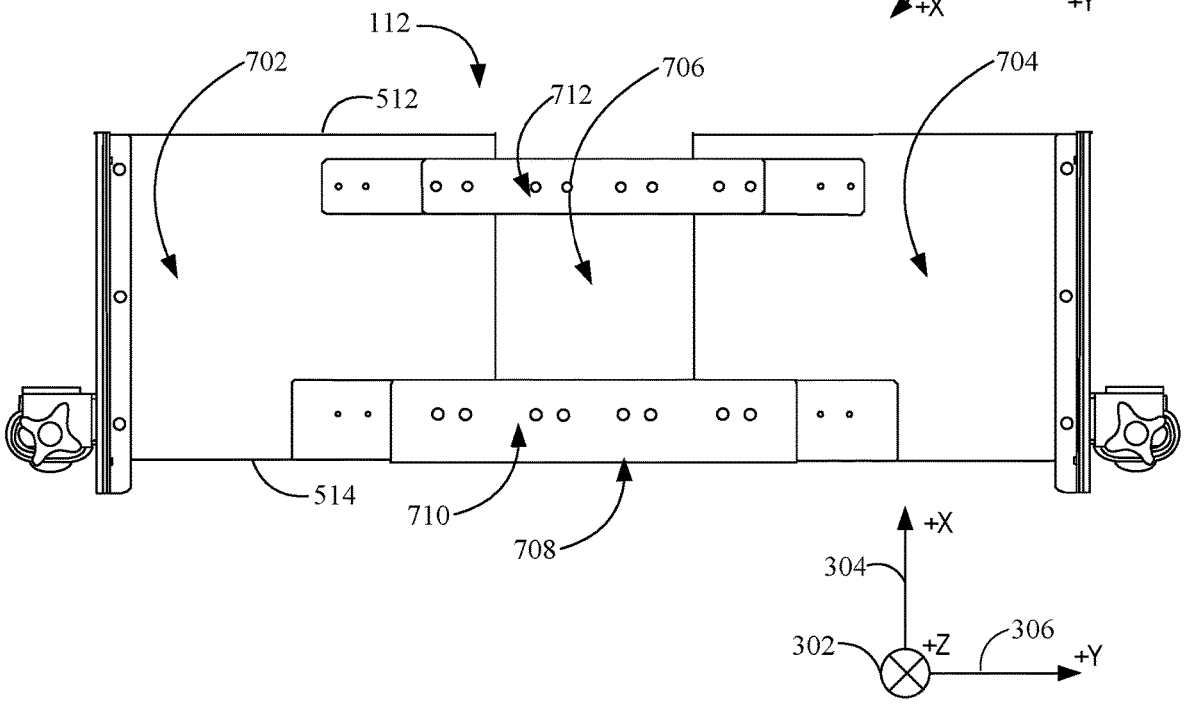
FIG. 7B is a bottom view of the example split variation of the multi-axis positionable tray of FIG. 7A.
Figure 7C:
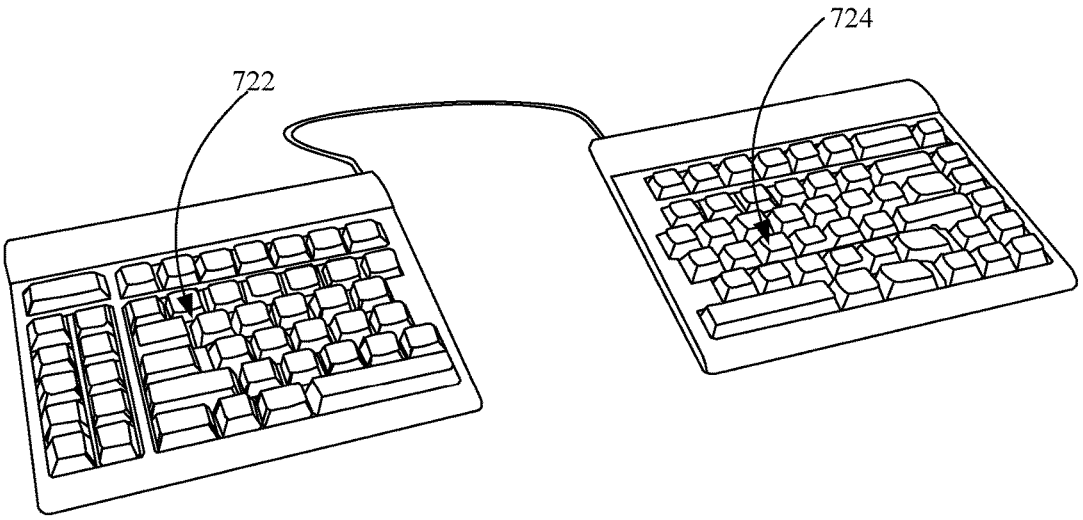
FIG. 7C is a perspective view of an example split keyboard.
Figure 7D:
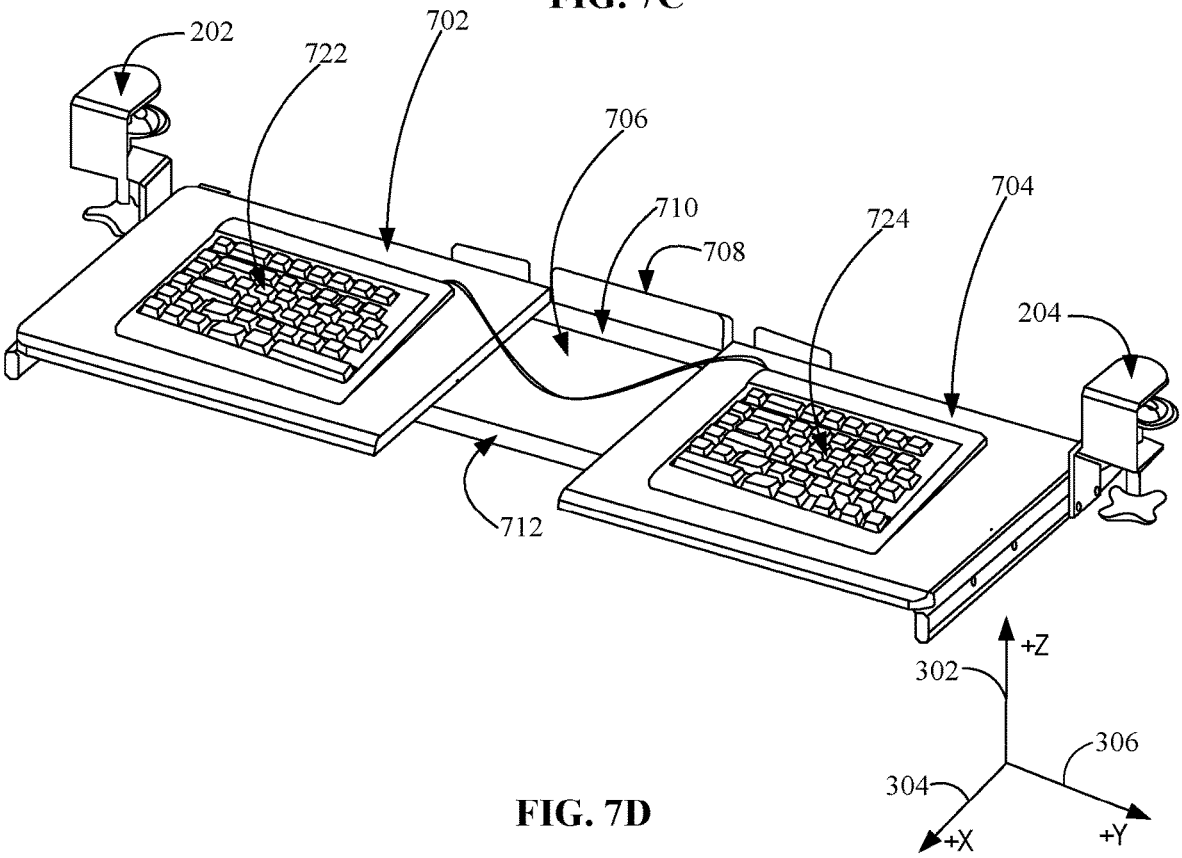
FIG. 7D is a perspective view of the example split keyboard on the split variation of the multi-axis positionable tray of FIG. 7A.

FIG. 7B illustrates the bottom view of the example variation of FIG. 7A, wherein, the first bracket 710 and the second bracket 712 are to support the first portion 702 and the second portion 704. FIG. 7B is similar to FIG. 5B and FIG. 6B. FIG. 7B illustrates a sub-frame variation of the two piece variation of the example multi-axis positionable tray apparatus 112. In FIG. 7B, the first bracket 710 and the second bracket 712 act as a set of joining plates to tie the two sections (the first portion 702 and the second portion 704). In other examples, a different number of brackets or joining plates may be used (such as three). In some examples, the backstop 708 acts as a joining plate. In some examples, dowels and/or other rods, etc., illustrated by the dowel holes 718, act to further support the first portion 702 and the second portion 704. In some examples, the dowels travel through the first portion 702 and the dowel hole 718 and connect to a corresponding dowel hole in the second portion 704. In some examples, glue is used in conjunction with the dowels.

FIG. 7C illustrates an example split keyboard including a first left hand keyboard portion 722 and a second right hand keyboard portion 724.

FIG. 7D illustrates the example split keyboard, wherein a first left hand keyboard portion 722 is supported by the example first portion 702 of the example multi-axis positionable tray apparatus 112 and a second right hand keyboard portion 724 is supported by the example second portion 704 of the example multi-axis positionable tray apparatus 112.

Figure 8A:
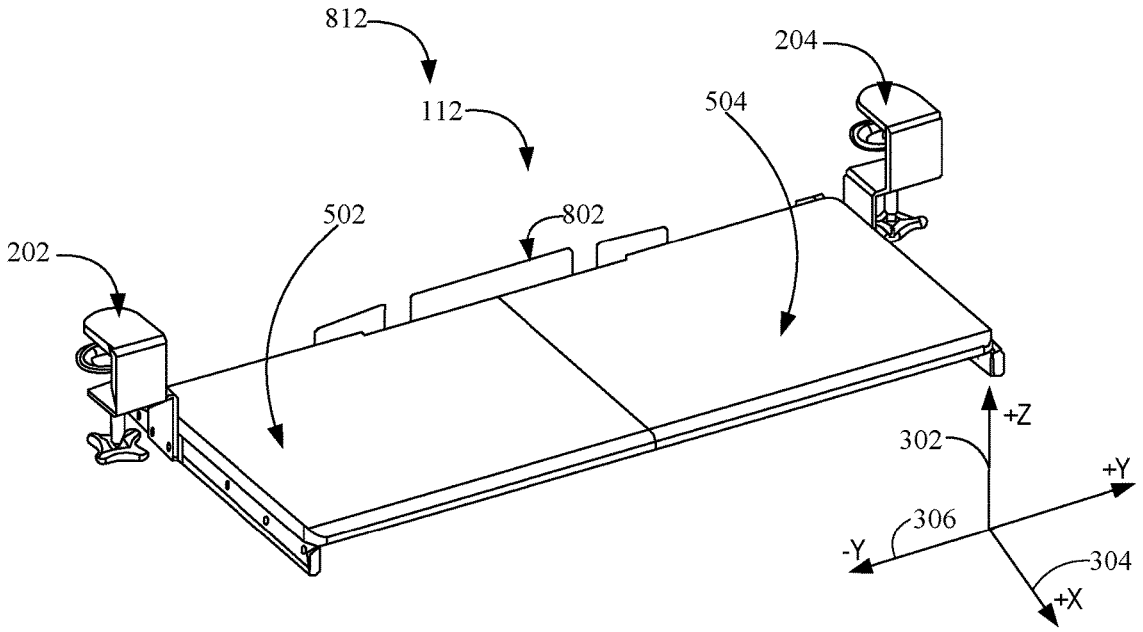
FIG. 8A is a top perspective view of a variant of the example multi-axis positionable tray wherein the backstop of the multi-axis positionable tray is reinforced.

FIG. 8A is an example perspective view of an example variation 812 of the multi-axis positionable tray apparatus 112 wherein the backstop 506 is reinforced. In the example of FIG. 8A, the first portion 502 and the second portion 504 is similar to the first portion 502 and the second portion 504 of FIG. 5A. FIG. 8A includes a reinforced backstop 802 which is arranged differently than the corresponding backstop 506 of FIG. 5A, such that the reinforced backstop 802 is reinforced by multiple connectors (shown in the example view of FIG. 8B).

Figure 8B:
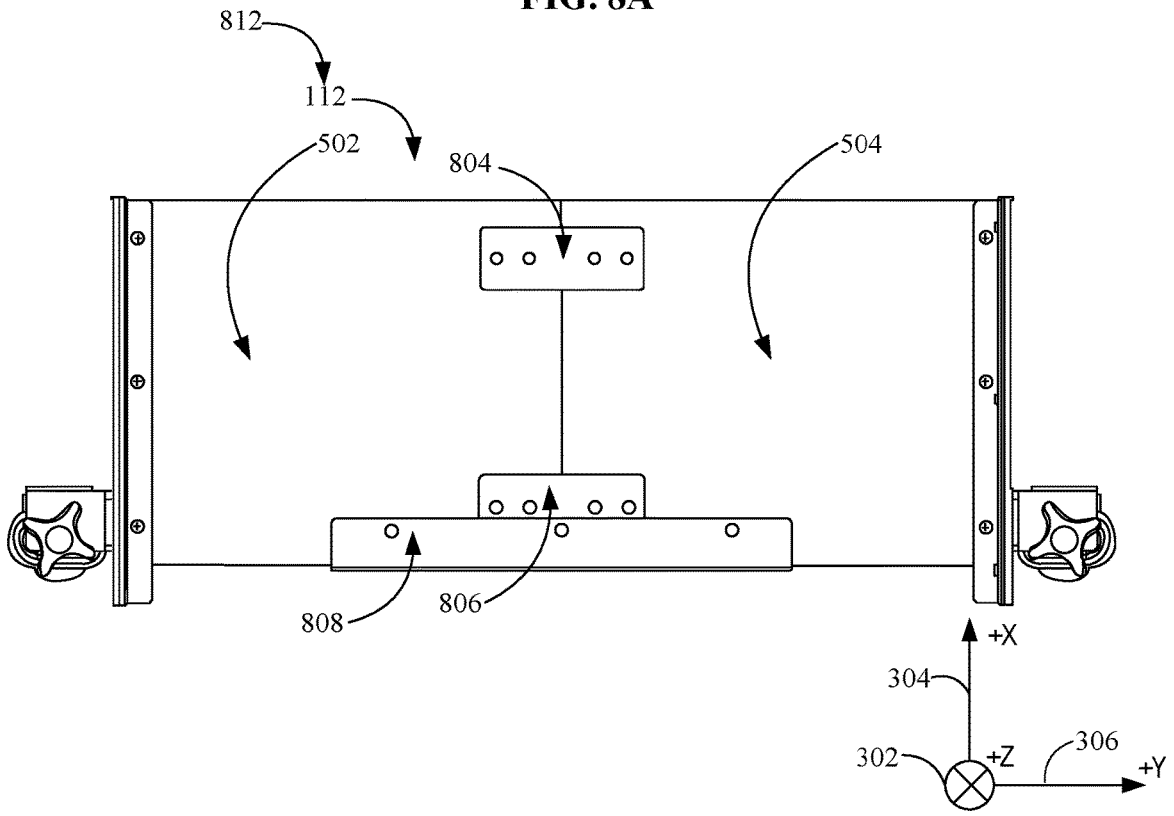
FIG. 8B is a bottom view of the variant multi-axis positionable tray of FIG. 8A.

FIG. 8B is the bottom view of the example variation 812 of the multi-axis positionable tray apparatus 112. In the example of FIG. 8B, the example reinforced backstop 802 (e.g., backplate, guard rail, etc.) is shown including a first portion connector 804, a second portion connector 806, and a third portion connector 808. The first portion connector 804 and the second portion connector 806 are shorter and/or otherwise involve less material to form than the corresponding first portion connector 508 of FIG. 5B and the corresponding second portion connector 510 of FIG. 5B. The load (e.g., weight, burden) of supporting the first portion 502 and the example second portion 504 is reacted by the example reinforced backstop 802 such that the example first portion connector 804 and the example second portion connector 806 are not arranged to support as much weight as the corresponding first portion connector 508 of FIG. 5B and the corresponding second portion connector 510 of FIG. 5B because the example reinforced backstop 802 wraps around the example first portion 502 and the example second portion 504 to form the example variant portion connector 808, which secures and reinforces the example second portion connector 806. In some examples, the first portion connector 804 is a first bracket 804, and the second portion connector 806 is a second bracket 806, and the example third portion connector 808 is a bottom edge of the example backstop 802 folded around the first and second portions 502, 504 and over the second portion connector 806. In some examples, the backstop 802 is used as a joining plate.

Figure 9A:
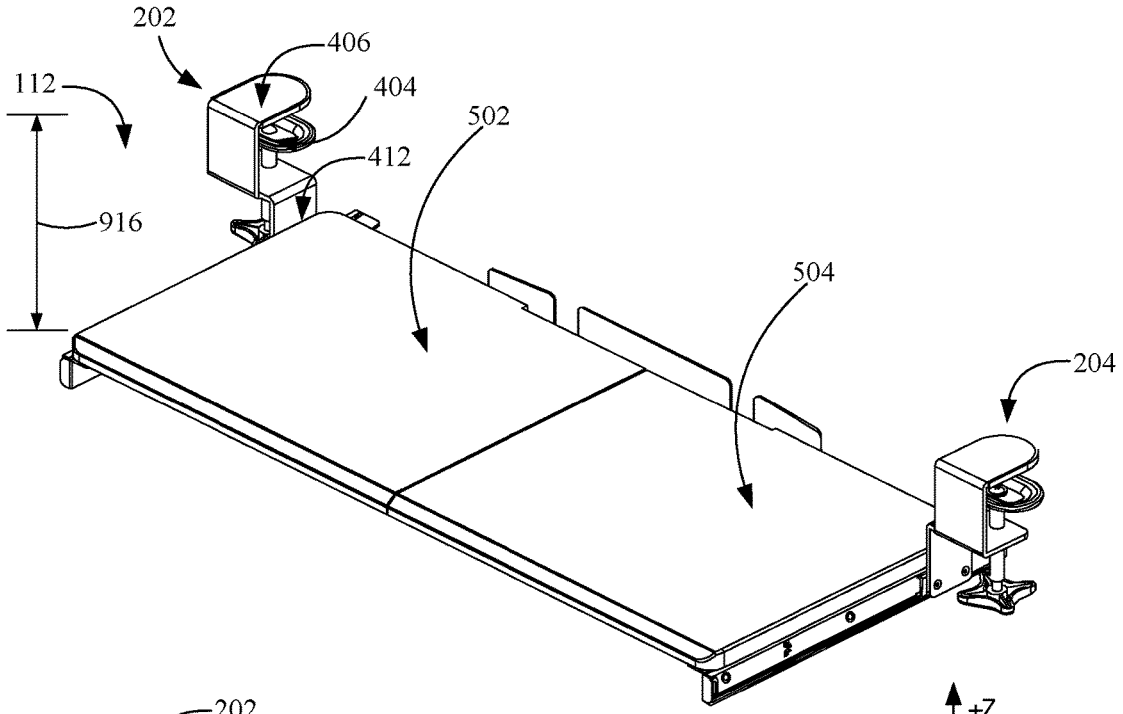
FIGS. 9A-B illustrates the height adjustment capability of the clamps for the example multi-axis positionable tray of FIGS. 5A-5B.
Figure 9B:
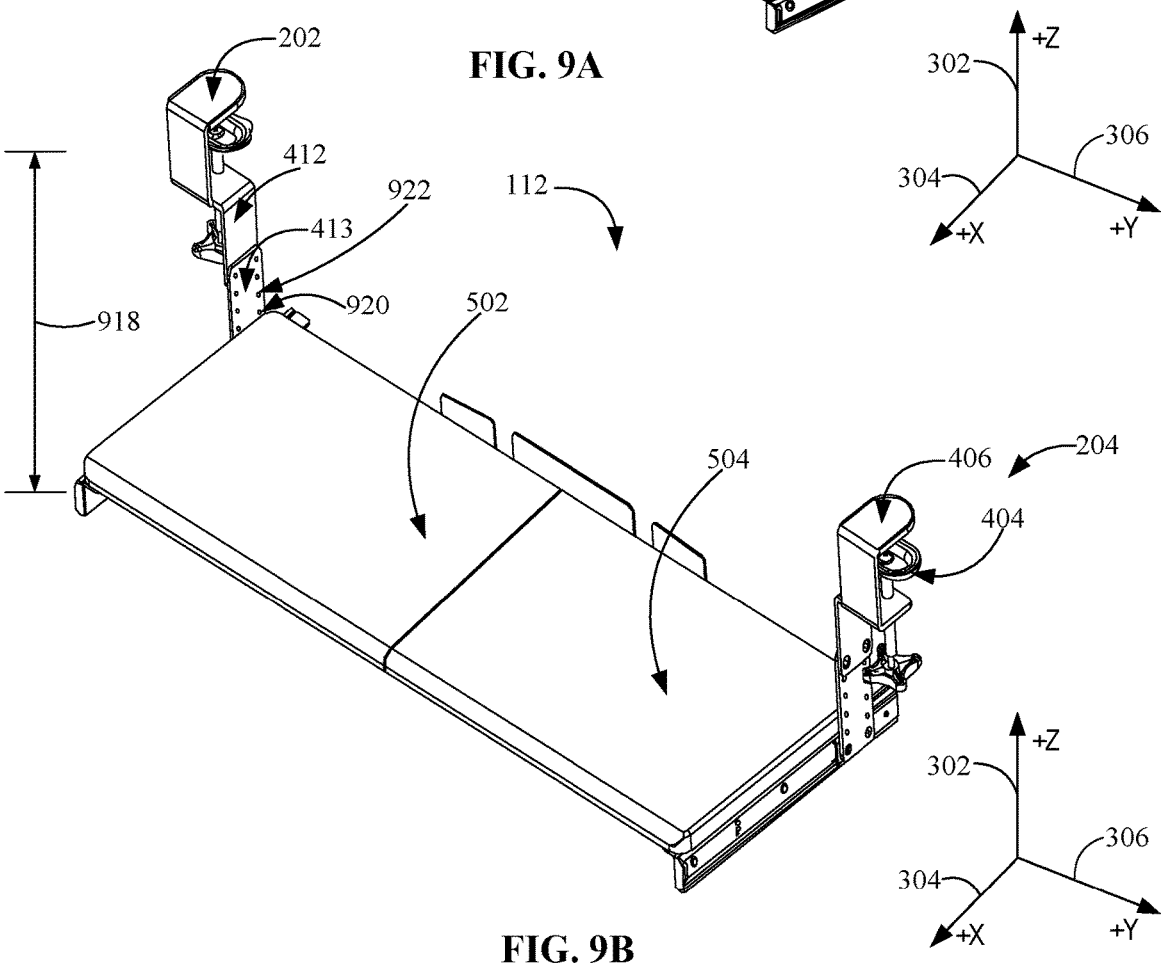

FIG. 9A illustrates example vertical adjustment capabilities of the multi-axis positionable tray apparatus 112 along the vertical axis Z 302. In the example of FIGS. 9A-B, the split-tray arrangement is used, such that the first portion 502 and the second portion 504 are configured to be shipped from a manufacturer in a smaller box, such that a user can assemble the two portions, and saving costs for the shipping company. The jaws of the desk clamp (e.g., first clamp 202, second clamp 204) is still configured to be secured to a surface (e.g., desk, table, counter, etc.). The multi-axis positionable tray apparatus 112 is in the minimum extended position along the vertical axis Z 302 (e.g., the position closest to the farthest edge of the table, the position farthest from the knees of the user, the most compact position, wherein the first extension distance 916 is minimized, etc.). The extension distance is from the top-most edge of the clamp to the bottom of the tray along the vertical axis Z 302.

FIG. 9B illustrates a second extension distance 918 that is farther (e.g., longer) than the first extension distance 916 of FIG. 9A. In the example of FIG. 9B, the desk clamp (e.g., first clamp 202, second clamp 204) is connected in the same position to the table (not shown). In the example of FIG. 9B, the first adjustment plate 412 and the second adjustment plate 413 are extended. In the example of FIG. 9B, there are four groups of screws, wherein each group corresponds to a different position along the vertical axis Z 302, such that the tray portions 502, 504 of the multi-axis positionable tray apparatus 112 are able to be positioned at a variety of different positions along the vertical axis Z 302.

Figure 10A:
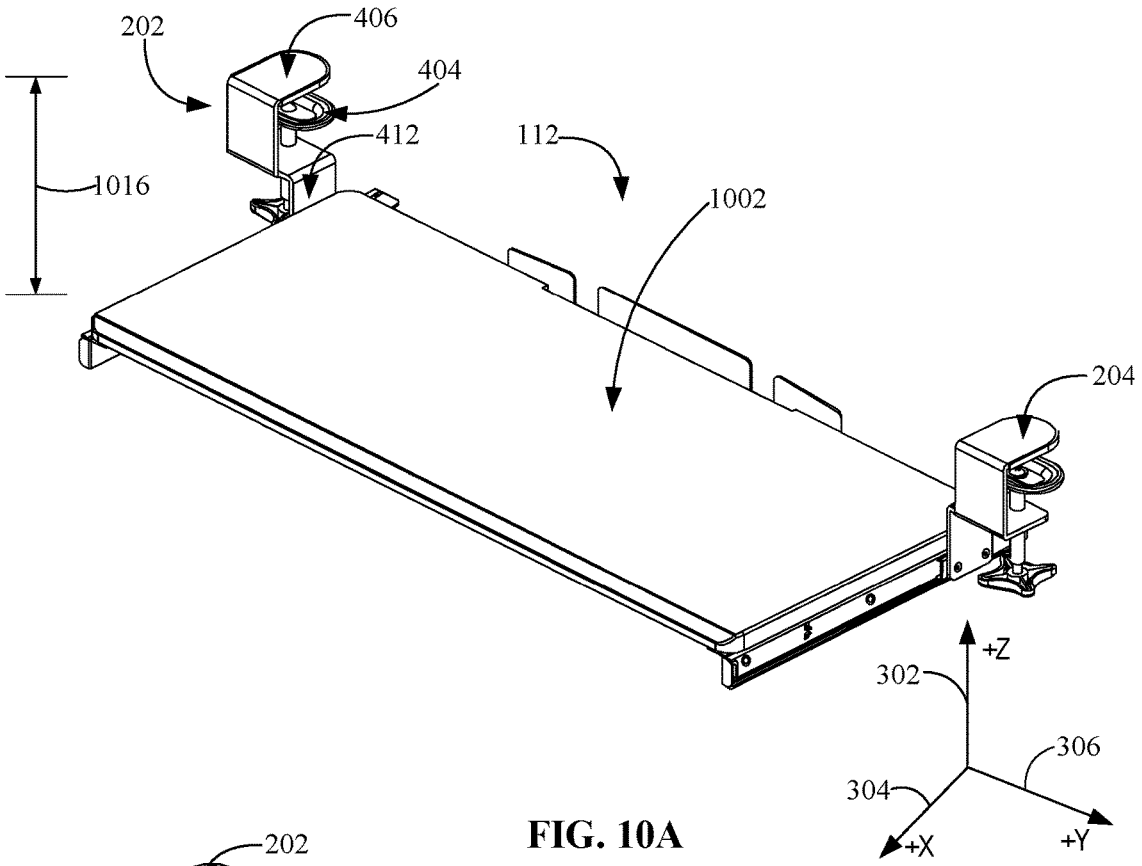
FIGS. 10A-B illustrates the height adjustment capability of the clamps for an example variation of the multi-axis positionable tray wherein there is a solid portion replacing a first portion and a second portion for the tray.
Figure 10B:
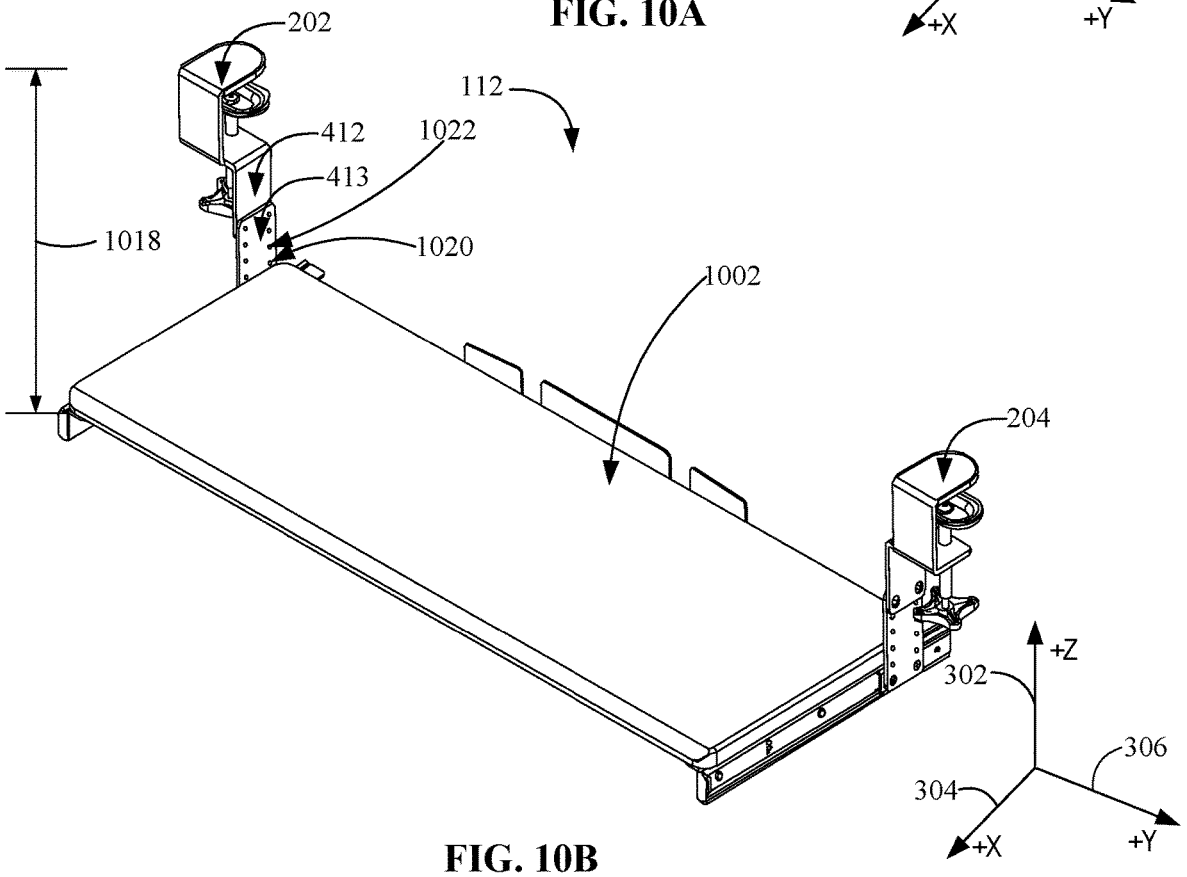
Figure 11:
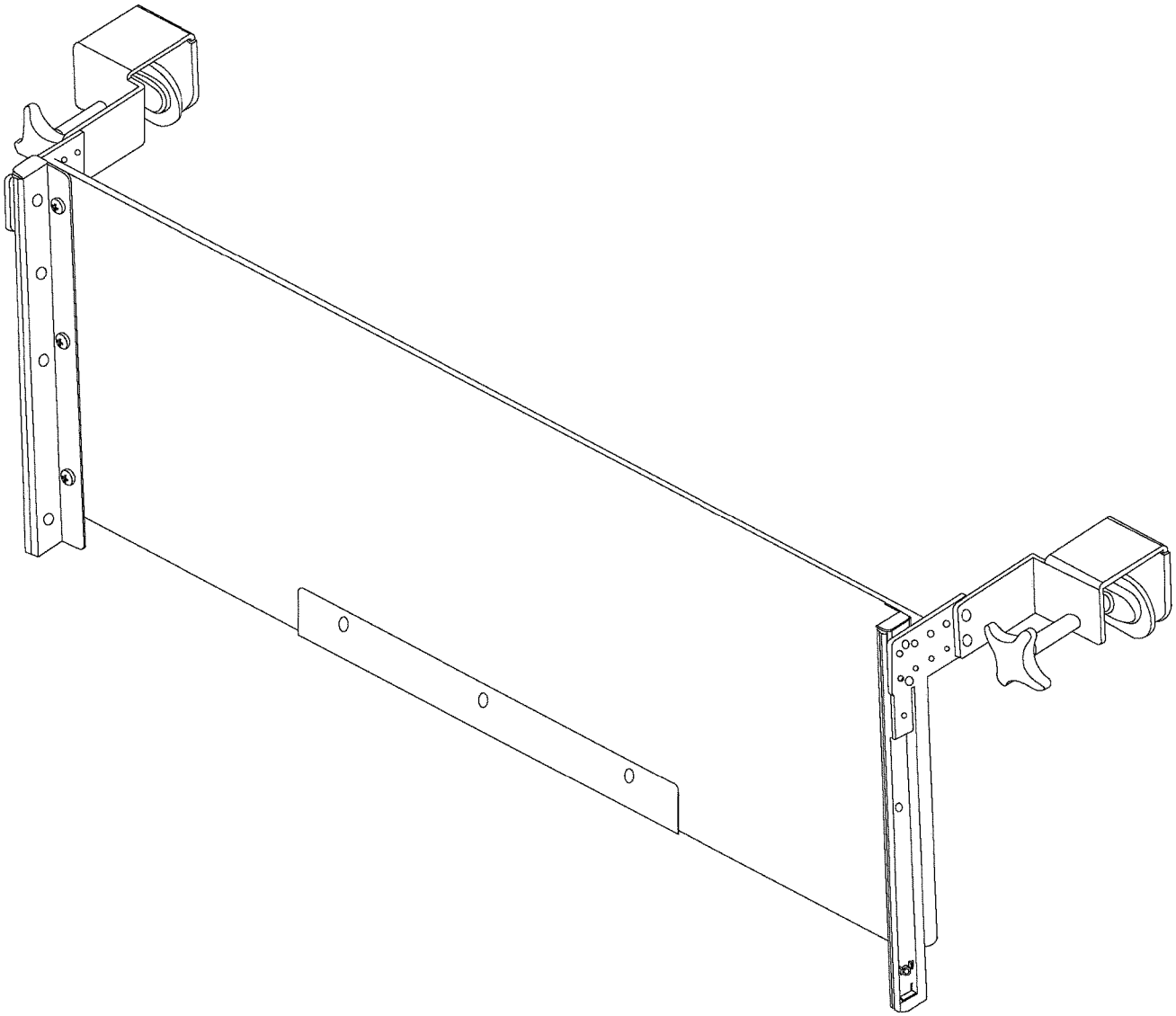
FIGS. 11-17 illustrate additional views of the example multi-axis positionable tray apparatus.
Figure 12:
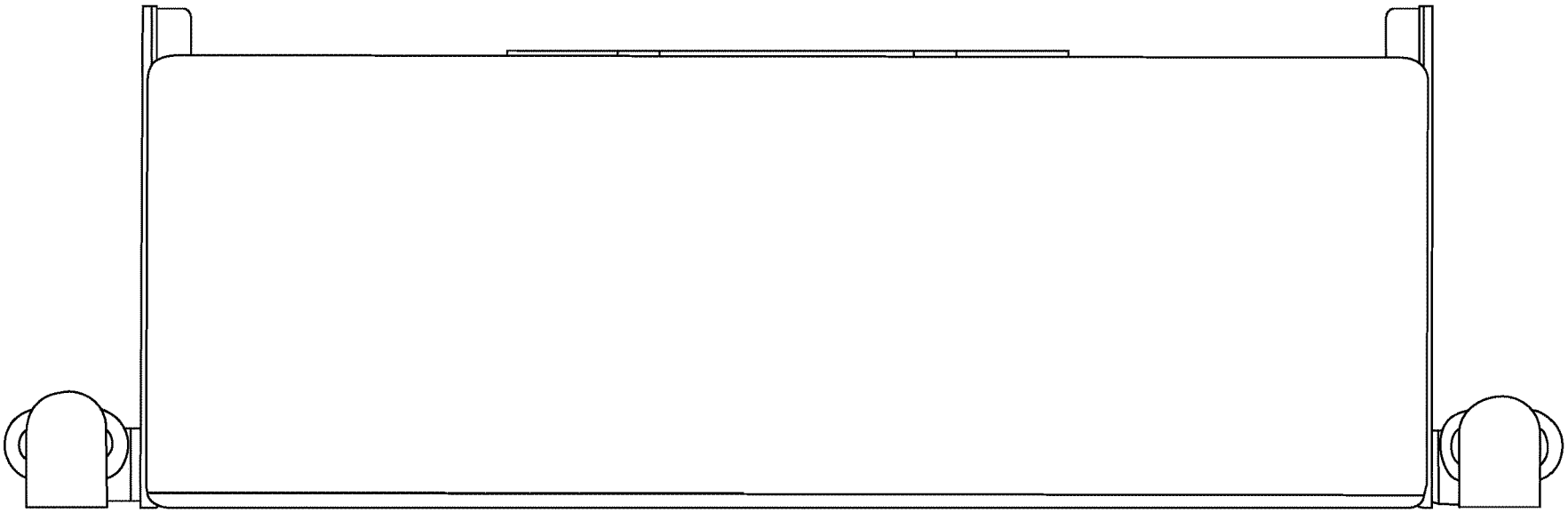
Figure 13:
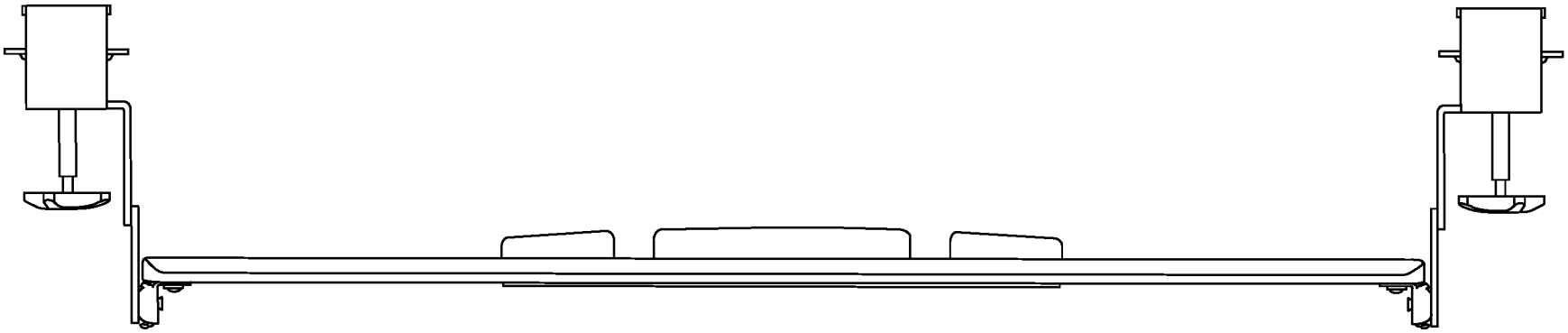
Figure 14:
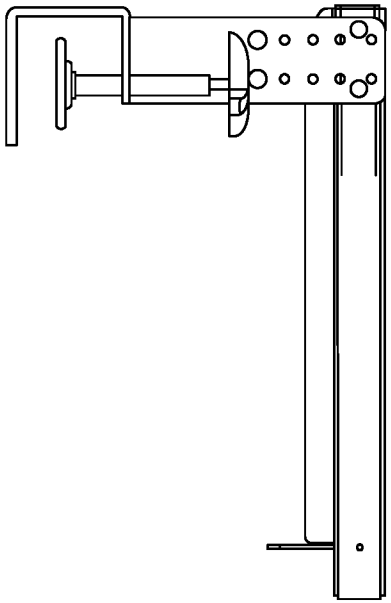
Figure 15:
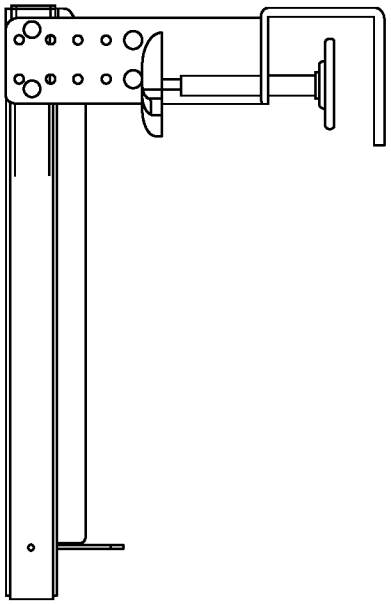
Figure 16:
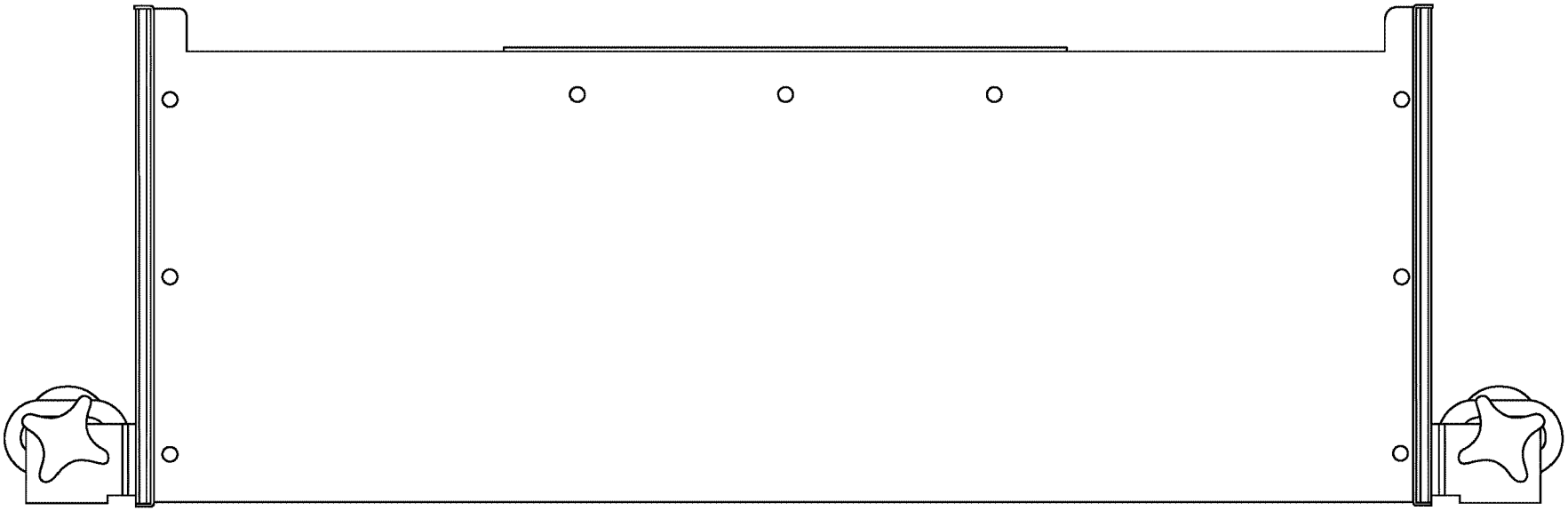
Figure 17:
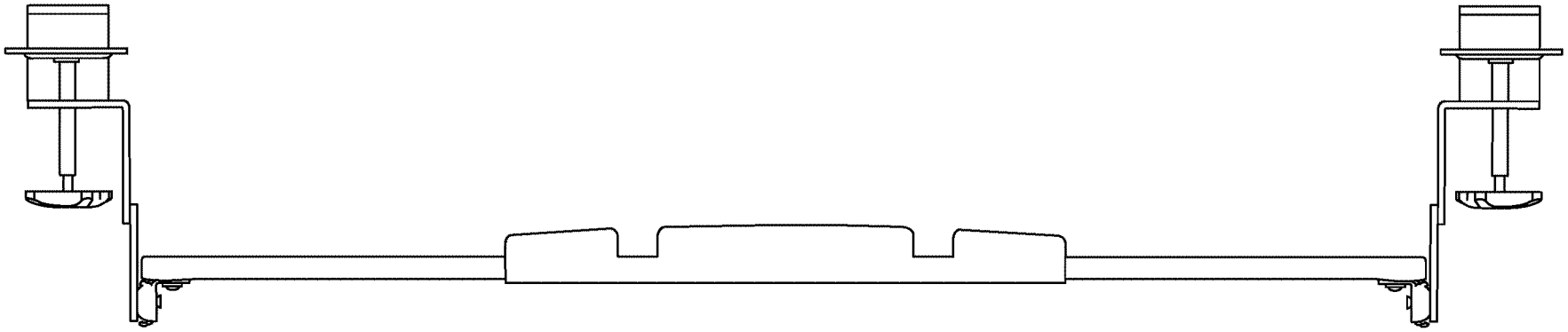

The example of FIGS. 10A and 10B illustrates the vertical adjustment capabilities of the example first clamp 202 and the example second clamp 204 with respect to a single tray portion 1002, rather than multiple tray portions 502, 504 of FIGS. 9A and 9B. As shown in FIGS. 10A-B, a vertical position of the example single tray portion 1002 can be adjusted by the first jaw or first clamping member 404 and the second jaw or second clamping member 406 of the example first clamp 202 and corresponding jaws for the example second clamp 204. The example first adjustment plate 412 and second adjustment plate 413 enable a vertical positioning at the set of holes such as the first set of holes 1022 or the second set of holes 1020. The example adjustment plates 412, 413 are able to extend to from the distance 1016 in FIG. 10A to the example distance 1018 in FIG. 10B along the vertical axis Z 302.

FIGS. 11-17 are alternative views of the example multi-axis positionable tray apparatus 112.

"Including" and "comprising" (and all forms and tenses thereof) are used herein to be open ended terms. Thus, whenever a claim employs any form of "include" or "comprise" (e.g., comprises, includes, comprising, including, having, etc.) as a preamble or within a claim recitation of any kind, it is to be understood that additional elements, terms, etc. may be present without falling outside the scope of the corresponding claim or recitation. As used herein, when the phrase "at least" is used as the transition term in, for example, a preamble of a claim, it is open-ended in the same manner as the term "comprising" and "including" are open ended. The term "and/or" when used, for example, in a form such as A, B, and/or C refers to any combination or subset of A, B, C such as (1) A alone, (2) B alone, (3) C alone, (4) A with B, (5) A with C, (6) B with C, and (7) A with B and with C. As used herein in the context of describing structures, components, items, objects and/or things, the phrase "at least one of A and B" is intended to refer to implementations including any of (1) at least one A, (2) at least one B, and (3) at least one A and at least one B. Similarly, as used herein in the context of describing structures, components, items, objects and/or things, the phrase "at least one of A or B" is intended to refer to implementations including any of (1) at least one A, (2) at least one B, and (3) at least one A and at least one B. As used herein in the context of describing the performance or execution of processes, instructions, actions, activities and/or steps, the phrase "at least one of A and B" is intended to refer to implementations including any of (1) at least one A, (2) at least one B, and (3) at least one A and at least one B. Similarly, as used herein in the context of describing the performance or execution of processes, instructions, actions, activities and/or steps, the phrase "at least one of A or B" is intended to refer to implementations including any of (1) at least one A, (2) at least one B, and (3) at least one A and at least one B.

As used herein, singular references (e.g., "a", "an", "first", "second", etc.) do not exclude a plurality. The term "a" or "an" entity, as used herein, refers to one or more of that entity. The terms "a" (or "an"), "one or more", and "at least one" can be used interchangeably herein. Furthermore, although individually listed, a plurality of means, elements or method actions may be implemented by, e.g., a single unit or processor. Additionally, although individual features may be included in different examples or claims, these may possibly be combined, and the inclusion in different examples or claims does not imply that a combination of features is not feasible and/or advantageous.

From the foregoing, it will be appreciated that example methods, apparatus and articles of manufacture have been disclosed that mount a camera to a mounting plate. Example methods, apparatus, systems, and articles of manufacture to position a keyboard, mouse, etc., are disclosed herein. Further examples and combinations thereof include the following:

Example 1 includes a multi-axis positionable tray apparatus for securing a keyboard, the multi-axis positionable tray apparatus comprising a tray portion, wherein the tray portion is configured to move along at least a first axis and a second axis, a first positioner to provide positional adjustment along the first axis, wherein the first positioner removably attaches the multi-axis positionable tray apparatus with respect to a mounting surface, and a second positioner to provide positional adjustment along the second axis, wherein the second positioner allows the multi-axis positionable tray to move towards a user.

Example 2 includes the apparatus of example 1, wherein the first axis is a vertical axis and the first positioner is a vertical positioner including a first clamp and a second clamp, the first clamp and the second clamp to secure the multi-axis positionable tray with respect to the mounting surface.

Example 3 includes the apparatus of example 1, wherein the mounting surface is at least one of a desk, table, or ledge.

Example 4 includes the apparatus of example 1, wherein the first axis is a vertical axis and the first positioner is a vertical positioner including a first clamp and a second clamp, the first clamp and the second clamp to suspend the multi-axis positionable tray from the mounting surface.

Example 5 includes the apparatus of example 4, wherein the first clamp includes a first adjustment plate including a plurality of holes to enable height adjustment along a vertical axis.

Example 6 includes the apparatus of example 1, further including a third positioner to allow adjustment along a third axis, wherein the third positioner enables the multi-axis positionable tray to extend laterally in length.

Example 7 includes the apparatus of example 6, wherein the third axis is a lateral axis and the third positioner is a lateral positioner, wherein the multi-axial positionable tray is divided into a first right hand tray portion and a second left hand tray portion such that the lateral positioner is to adjust a distance between the first right hand tray portion and the second left hand tray portion.

Example 8 includes the apparatus of example 6, wherein the second axis is a horizontal axis, such that the horizontal positioner is a rail system allowing the multi-axial positionable tray to extend either towards or away from the user along the horizontal axis.

Example 9 includes the apparatus of example 8, wherein the multi-axis positionable tray apparatus is configured to move a range from 0 to 9 inches along the second axis towards a user.

Example 10 includes the apparatus of example 1, wherein the multi-axis positionable tray apparatus is located at a coordinate in three dimensional space, wherein the coordinate includes at least a position along one of the first axis, the second axis, and the third axis.

Example 11 includes the apparatus of example 10, wherein the coordinate in three dimensional space includes a first position along the first axis, a second position along the second axis, and a third position along the third axis.

Example 12 includes the apparatus of example 1, further including a backstop.

Example 13 includes the apparatus of example 1, wherein the multi-axis positionable tray apparatus is composed of a first tray portion and a second tray portion.

Example 14 includes the apparatus of example 13, further including a shipping container, wherein the multi-axis positionable tray is to be packaged and shipped from a manufacturer.

Example 15 includes the apparatus of example 13, further including a third tray portion, wherein the third tray portion is positioned between the first tray portion and the second tray portion.

Example 16 includes the apparatus of example 13, wherein the first tray portion and the second tray portion are not connected.

Example 17 includes an apparatus for securing a keyboard underneath a desk, the apparatus comprising a multi-axis positionable tray portion, wherein the multi-axis positionable tray portion is positionable at a coordinate in three dimensional space at a first position on a first axis, a second position on a second axis, and a third position on a third axis, the third axis normal to the first axis and the second axis, a vertical positioner to adjust the multi-axis positionable tray portion in a plurality of positions defined along a vertical plane, the vertical plane defined with respect to a surface to which the apparatus is attached, the vertical plane defined by the first axis, a horizontal positioner to adjust the multi-axis positionable tray portion in a plurality of positions defined along a horizontal plane defined with respect to the surface to which the apparatus is attached, the horizontal plane defined by the second axis, such that the multi-axis positionable tray portion is able to move towards or away from a user, and a lateral positioner to adjust a length of the multi-axis positionable tray portion along a lateral plane defined with respect to the surface to which the apparatus is attached, the lateral planed defined by the third axis.

Example 18 includes the apparatus of example 17 further including a set of clamps to secure the multi-axis positionable tray with respect to the surface the multi-axis positionable tray is attached.

Example 19 includes an apparatus for securing a keyboard underneath a surface, the apparatus comprising a first means for securing the keyboard underneath the surface, a second means for adjusting the first means in a plurality of positions defined along a vertical plane, a third means for adjusting the first means in a plurality of positions defined along a horizontal plane, and a fourth means for adjusting the first means in a plurality of positions defined along a lateral plane.

Example 20 includes the apparatus of example 19, wherein the first means is a tray portion.

Although certain example methods, apparatus and articles of manufacture have been disclosed herein, the scope of coverage of this patent is not limited thereto. On the contrary, this patent covers all methods, apparatus and articles of manufacture fairly falling within the scope of the claims of this patent.

The following claims are hereby incorporated into this Detailed Description by this reference, with each claim standing on its own as a separate embodiment of the present disclosure.

What is claimed is:

1. A multi-axis positionable tray apparatus for securing a keyboard, the multi-axis positionable tray apparatus comprising:

a tray portion, wherein the tray portion is configured to move along at least a first axis and a second axis;

a first positioner to provide positional adjustment along the first axis, the first positioner including a first clamp, a second clamp, first adjustment plates extending from the first and second clamps, and second adjustment plates, each of the first adjustment plates including first holes at a first position relative to the first axis, each of the second adjustment plates including a plurality of second holes at different positions relative to the first axis, wherein the first and second clamps removably attach the multi-axis positionable tray apparatus with respect to a mounting surface;

a second positioner to provide positional adjustment along the second axis, wherein the second positioner allows the tray portion to move relative to the mounting surface; and wherein the second adjustment plates couple to and extend from the second positioner, wherein a first one of the first adjustment plates removably attaches to a respective one of the second adjust plates by positioning pins through respective first holes and first ones of the second holes that are aligned with the respective first holes.

2. The apparatus of claim 1, wherein the first axis is a vertical axis and the first positioner is a vertical positioner, the first clamp and the second clamp to secure the multi-axis positionable tray apparatus with respect to the mounting surface, wherein the first adjustment plates and the second adjustment plates provide the positional adjustment along the vertical axis by aligning second ones of the second holes with the first holes and positioning the pins through the first holes and the second ones of the second holes.

3. The apparatus of claim 1, wherein the mounting surface is at least one of a desk, table, or ledge.

4. The apparatus of claim 1, wherein the first axis is a vertical axis and the first positioner is a vertical positioner, the first clamp and the second clamp to suspend the tray portion from the mounting surface.

5. The apparatus of claim 4, wherein the first adjustment plates and the second adjustment plates include the first holes and the second holes, respectively, to enable height adjustment along a vertical axis;

wherein the first holes align with the first ones of the second holes to form a first alignment position at a first vertical distance from the mounting surface, and the first holes align with second ones of the second holes to form a second alignment position at a second vertical distance from the mounting surface; and wherein a third vertical distance between the first alignment position and the second alignment position defines a first extension distance along the vertical axis.

6. The apparatus of claim 1, further including a third positioner to allow adjustment along a third axis, wherein the third positioner enables the multi-axis positionable tray apparatus to extend or retract in length relative to the third axis.

7. The apparatus of claim 6, wherein the third axis is a lateral axis and the third positioner is a lateral positioner, and wherein the tray portion includes a first tray portion that is detachable from a second tray portion such that the lateral positioner is to adjust a distance between the first tray portion and the second tray portion to laterally adjust the multi-axis positionable tray apparatus.

8. The apparatus of claim 7, further including a third tray portion, wherein the third tray portion is removably positioned between the first tray portion and the second tray portion.

9. The apparatus of claim 8, wherein the third tray portion is the lateral positioner, wherein the third tray portion is level with the first and the second tray portions.

10. The apparatus of claim 7, wherein the first tray portion and the second tray portion are not connected, the multi-axis positionable tray apparatus including (a) a left-hand portion corresponding to the first clamp and the first tray portion, the left-hand portion of the multi-axis positionable tray apparatus to support the first tray portion, and (b) a right-hand portion corresponding to the second clamp and the second tray portion, the right-hand portion of the multi-axis positionable tray apparatus to support the second tray portion.

11. The apparatus of claim 7, wherein the lateral positioner is a bracket, the bracket to enable connection of the first tray portion and the second tray portion at different lateral positions such that the first tray portion and the second tray portion may be positioned at any point along a length of the bracket.

12. The apparatus of claim 6, wherein the tray portion is located at a coordinate in three dimensional space, wherein the coordinate includes at least a position along one of the first axis, the second axis, and the third axis.

13. The apparatus of claim 12, wherein the coordinate in three dimensional space includes:

a first position along the first axis, the first position corresponding to a height of the tray portion;

a second position along the second axis, wherein the second axis is normal relative to the first axis and the third axis; and a third position along the third axis, the third position corresponding to a length of the tray portion.

14. The apparatus of claim 1, wherein the second axis is a horizontal axis and the second positioner is a rail system, the rail system to allow the tray portion to extend along the horizontal axis, the rail system to enable the tray portion to be positioned at different points along a length of the rail system.

15. The apparatus of claim 14, wherein the tray portion is configured to move from 0 to 9 inches along the second axis relative to the mounting surface.

16. The apparatus of claim 1, further including a backstop coupled to the tray portion.

17. An apparatus for securing a keyboard underneath a desk, the apparatus comprising:

a multi-axis positionable tray portion, wherein the multi-axis positionable tray portion is positionable at a coordinate in three dimensional space at a first position on a first axis, a second position on a second axis, and a third position on a third axis, the third axis normal to the first axis and the second axis;

a vertical positioner to adjust the multi-axis positionable tray portion in a plurality of positions defined along a vertical plane, the vertical plane defined with respect to a surface to which the apparatus is attached, the vertical plane defined by the first axis;

a horizontal positioner to adjust the multi-axis positionable tray portion in a plurality of positions defined along a horizontal plane defined with respect to the surface to which the apparatus is attached such that the multi-axis positionable tray portion is able to move towards or away from a user, the horizontal plane defined by the second axis;

a lateral positioner to adjust a length of the multi-axis positionable tray portion along a lateral plane defined with respect to the surface to which the apparatus is attached, the lateral planed defined by the third axis, wherein the lateral positioner is to adjust the length of the multi-axis positionable tray portion while the multi-axis positionable tray portion is at any of the plurality of positions defined along the horizontal plane; and clamps to secure the multi-axis positionable tray portion with respect to the surface to which the multi-axis positionable tray portion is attached.

18. An apparatus for securing a keyboard underneath a surface, the apparatus comprising:

a first means for securing the keyboard underneath the surface;

a second means for adjusting the first means in a plurality of positions defined along a vertical plane, the second means including clamping means for removably attaching the apparatus to the surface;

a third means for adjusting the first means in a plurality of positions defined along a horizontal plane; and a fourth means for adjusting the first means in a plurality of positions defined along a lateral plane, wherein the fourth means is to adjust the first means in the plurality of positions defined along the lateral plane while the first means are at any of the plurality of positions defined along the vertical plane and the plurality of positions defined along the horizontal plane.

19. The apparatus of claim 18, wherein the first means is a tray portion, the tray portion including a first tray portion detachably coupled to a second tray portion.

20. The apparatus of claim 18, wherein the second means facilitate the first means being removably attachable to the surface.

* * * * *